US011035338B2

(12) United States Patent
Parhar et al.

(10) Patent No.: US 11,035,338 B2
(45) **Date of Patent: *Jun. 15, 2021**

(54) LOAD BALANCED POWER SECTION OF PROGRESSING CAVITY DEVICE

(71) Applicant: Weatherford Technology Holdings, LLC, Houston, TX (US)

(72) Inventors: Harjinder Singh Parhar, Edmonton (CA); Travis Lee Chometsky, Leduc (CA); Michael W. Kuhlman, Kingwood, TX (US); Wayne Robert Pilgrim, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 296 days.

This patent is subject to a terminal disclaimer.

(21) Appl. No.: 15/814,541

(22) Filed: Nov. 16, 2017

(65) Prior Publication Data

US 2019/0145374 A1 May 16, 2019

(51) Int. Cl.
*F03C 2/08* (2006.01)
*E21B 4/02* (2006.01)
(Continued)

(52) U.S. Cl.
CPC ..... *F03C 2/08* (2013.01); *E21B 4/02* (2013.01); *E21B 43/126* (2013.01);
(Continued)

(58) Field of Classification Search
CPC .... F03C 2/08; F04C 2240/10; F04C 2240/20; F04C 2240/802; F04C 2/1075
See application file for complete search history.

(56) References Cited

U.S. PATENT DOCUMENTS 5,120,204 A 6/1992 Matthewson et al.
5,722,820 A 3/1998 Wild et al.
(Continued)

FOREIGN PATENT DOCUMENTS

WO 2016/106109 A1 6/2016

OTHER PUBLICATIONS

Dunn, L., "Progressing Cavity Pumping Systems Overview with a Focus on Coalseam Gas Applications," SPE Queensland Bisbane, Mar. 9, 2015, 105-pgs.

(Continued)

*Primary Examiner* — Mary Davis
(74) *Attorney, Agent, or Firm* — Blank Rome LLP

(57) ABSTRACT

A progressing cavity device operates as a motor to impart torque to a bit. A stator of the device defines an internal profile having uphole stages with a first dimension being less than a second dimension of downhole stage. A rotor has an external profile with a constant outer dimension along its length. Disposed in the stator, the rotor defines cavities with the stator and is rotatable with pumped fluid progressing in the cavities from the uphole to downhole to transfer torque to the drive toward the downhole end. Although the rotor is subjected at the downhole end to a reactive torque from the bit, the interference fit of the rotor's constant dimension with the stator's downhole stages is less than with the uphole stages, which can mitigate issues with heat buildup in the downhole stages. The device can also operates as a progressing cavity pump.

20 Claims, 10 Drawing Sheets

(51) Int. Cl.

| | |
|---|---|
| ***F04C 2/107*** | (2006.01) |
| ***F04C 13/00*** | (2006.01) |
| ***E21B 43/12*** | (2006.01) |

(52) U.S. Cl.

CPC ..... *F04C 2/1075* (2013.01); *F04C 13/008* (2013.01); *F04C 2240/10* (2013.01); *F04C 2240/20* (2013.01); *F04C 2240/802* (2013.01)

(56) References Cited

U.S. PATENT DOCUMENTS

| | | | | |
|---|---|---|---|---|
| 6,358,027 | B1 | 3/2002 | Lane | |
| 6,457,958 | B1 | 10/2002 | Dunn | |
| 7,396,220 | B2 * | 7/2008 | Delpassand ..... | F04C 2/1075 418/153 |
| 7,987,908 | B2 | 8/2011 | Colley, III | |
| 9,091,264 | B2 * | 7/2015 | Hohl ..... | F04C 2/1075 |
| 9,109,595 | B2 * | 8/2015 | Daunheimer ..... | F04C 2/1071 |
| 2005/0118040 | A1 | 6/2005 | Zitka et al. | |
| 2005/0285305 | A1 | 12/2005 | Neuroth | |
| 2014/0119974 | A1 | 5/2014 | Kitching | |
| 2014/0170011 | A1 | 6/2014 | Clouseau et al. | |
| 2016/0040480 | A1 | 2/2016 | Evans | |
| 2016/0208798 | A1 * | 7/2016 | Sawyer ..... | F04C 2/1075 |
| 2016/0348508 | A1 * | 12/2016 | Purcell ..... | F04C 2/1075 |
| 2017/0101990 | A1 | 4/2017 | Cariveau et al. | |
| 2020/0256311 | A1 * | 8/2020 | Parhar ..... | F04C 13/008 |

OTHER PUBLICATIONS

EPO Search Report received in copending EP Application No. 18206584.7 dated Apr. 12, 2019, 9 pages.

EPO Examination received in coutnerpart EP Application No. 18206584.7, dated Jun. 24, 2020, 4 pages.

First Office Action received in coutnerpart Canadian Application No. 3024018, dated Jan 2, 2020, 4 pages.

* cited by examiner

LOAD BALANCED POWER SECTION OF PROGRESSING CAVITY DEVICE

BACKGROUND OF THE DISCLOSURE

A progressing cavity motor (or positive displacement motor) can be run on a tubular, drillstring, or coiled tubing to drill a borehole, mill out plugs, and perform other operations. The motor has a power section that is powered by pumped drilling fluid to rotate a tool, such as a drill bit or end mill.

The power section typically has an outer steel housing, an injected elastomer stator with an internal stator profile, and a rotor with an external rotor profile. The stator profile has one more "lobe" than the rotor profile, which creates a cavity. As drilling fluid is forced through the power section, the fluid seeks the progressing cavity and causes the rotor to turn in the stator. The speed that the rotor spins is governed by the flow rate pumped through it and the displacement of the motor. The displacement is governed by the number of lobes, the major and minor diameters, and the pitch length in the configuration, and the torque generated is governed by the differential pressure and the displacement.

A progressing cavity pump can have a similar outer steel housing, an injected elastomer stator with an internal stator profile, and a rotor with an external rotor profile. Rotation is provided by a rod string, which rotates the rotor relative to the stator so fluid can be pumped from a suction end to a discharge end of the pump.

In both, each rotor tooth or "lobe" along the length of the rotor forms a cavity with a corresponding stator tooth or "lobe" as the rotor rotates. The number of these cavities or stages determines the amount of pressure differential across the device. Typically, the stator is an elastomer that flexibly engages the metal rotor with a tight interference so a seal is formed, leakage between stages can be minimized, and efficiency can be improved. The amount of flexible engagement between the rotor and stator can be referred to as a compressive fit or interference fit.

Some multi-stage power sections have a uniform interference fit throughout the length of the power section. These types of power sections do not carry the pressure load evenly across the complete power section length. For example, the stage of a progressing cavity motor closest to a drill bit or other cutting tool on the power section (i.e., the bottom stage) may carry the maximum load until the fluid slips and is taken up by the stage above it. This carrying of the load follows up the multiple stages of the power section, and the work involved generates heat in the stages of the power section.

Because most of the work (through the reactive torque) in the power section is performed in the bottom stages while drilling or during circulation, the bottom of the power section generates more heat. The generated heat causes the elastomer of the stator to thermally expand and increases the interference with the rotor. This generates even more heat that can degrade and weaken the material properties of the elastomer and can lead to damage known as chunking.

Issues with the heat distribution and thermal expansion in a multi-stage power section have been addressed in the past by using a contoured profile steel stator that has a thin elastomer coating on top. An example of this type of configuration is disclosed in U.S. Pat. No. 6,358,027, such as depicted in FIGS. 5-6. The contoured steel helps with the heat transfer distribution, and the minimum thickness of the elastomer controls the relative interference increase due to the rotor being under load. This solution is very effective, but may be expensive to construct. In another downside, the thickness and pliability of the elastomer is reduced on the contoured steel stator, and this limits the ability to manage solids in the fluid. For this reason, Moineau-type pumps and motors are preferred.

What is needed is a solution that can deal with the heat buildup and overloading of the stages of a power section to reduce damage and premature failure. The subject matter of the present disclosure is directed to overcoming, or at least reducing the effects of, one or more of the problems set forth above.

SUMMARY OF THE DISCLOSURE

A progressing cavity device according to the present disclosure can be used for imparting a first torque to a drive using fluid pumped along a tubular. As will be appreciated, the device can be used as a progressing cavity motor. For example, the device can include a coupling of the rotor to a cutting tool (e.g., drill bit, milling tool, etc.) driven with the fluid pumped from the uphole end to the downhole end from a drill string, coiled tubing, or the like.

The device comprises a housing, a stator lining, and a rotor. The housing couples in fluid communication with the tubular and having uphole and downhole ends with a bore defined therethrough. The stator lining is disposed in the bore of the housing and defines an internal profile along a first length of the stator lining. The internal profile at least has a first portion toward the uphole end of the housing with a first internal dimension being less than a second internal dimension of at least a second portion toward the downhole end of the housing.

The rotor has an external profile along a second length of the rotor and is disposed in the internal profile of the stator lining. The external profile having an outer dimension constant along the second length of the rotor. The rotor defines a plurality of sealed stage cavities with the stator lining. In response to the pumped drilling fluid progressing in the sealed stage cavities from the uphole end to the downhole end, the rotor is torqued and transfers the first torque to the drive toward the downhole end.

The device is subjected to a reactive torque generating heat toward the downhole end of the stator lining. The first portion of the stator lining at least has a first interference fit with the rotor being greater than a second interference fit of the second portion of the stator lining with the rotor. This non-uniform engagement or interference fit can evenly load pressure across all of the working stages in the device and can distribute the torque and heat evenly across the device, resulting in maintaining better material properties of the stator lining, providing more efficient use of the power section, and extending the life of the power section.

In general, the internal passage of the stator lining can define a plurality of lobes pitched along the first length of the stator lining, and the rotor can define a plurality of lobes pitched along the second length of the rotor and being less in number than the lobes. The first and second portions can each encompass a same number of the sealed stage cavities, although other variations are possible.

The internal dimensions of the at least two portions can have a number of various configurations. For example, the first internal dimension of the first portion can be constant along the first length, while the second internal dimension of the second portion can taper therefrom at an increasing angle outward. In another example, the first and second internal dimensions of the portions can both taper at increasing angles outward, with those angles for the sections being the same or different from one another. In an example, the first internal dimension can taper at an increasing angle outward, but the second internal dimension can be constant along the remaining length of the stator lining. In yet another example, the first and second internal dimensions can be constant along the length and can transition one to the other.

Previous examples discussed two portions, however, the stator lining can have more than two portions with a number of various configurations. For instance, the internal passage can having three portions, and the third portion further toward the downhole end of the housing can have a third internal dimension being greater at least in part than the second internal dimension of the second portion. In one example, the first internal dimension of the first portion can be constant, the second internal dimension of the second portion can taper therefrom at an increasing angle outward, and the third internal dimension of the third portion can be constant. In an alternative, the first, second, and third internal dimensions can each be constant respectively along the portions of the lining's length and can transition one to the other.

The stator lining preferably comprises an elastomeric material, which may be the same along the length of the lining. In a variation, the elastomeric material of the stator lining can include two or more sections of different stiffness. For example, a first section toward the uphole end of the housing can have a first stiffness that is greater than a second stiffness of at least a second section toward the downhole end of the housing. Furthermore, the elastomeric material can include a third section further toward the downhole end of the housing having a third stiffness being greater than the second stiffness of the second section.

Different elastomers can be used for each section. Alternatively, the elastomeric material can include a first elastomer for an uphole section, a second elastomer for a downhole section, and a mix of the first and second elastomers for an intermediate section.

Another progressing cavity device according to the present disclosure can be driven by a first torque imparted by a drive for pumping wellbore fluid in a tubular. As will be appreciated, the device can be used as a progressing cavity pump. For example, the device can include a coupling of the rotor to a drive string extending to surface equipment that drives the rotor to lift fluid in production tubing of a wellbore.

The device comprises a housing, a stator lining, and a rotor. The housing couples in fluid communication with the tubular. The housing has a downhole end and an uphole end and defines a bore therethrough. The downhole end is in fluid communication with the wellbore fluid, and the uphole end is in fluid communication with the tubular.

The stator lining is disposed in the bore of the housing and defines an internal profile along a first length of the stator lining. The internal profile at least has a first portion toward the downhole end of the housing with a first internal dimension that is less than a second internal dimension of at least a second portion toward the uphole end of the housing.

The rotor has an external profile along a second length of the rotor and is disposed in the internal profile of the stator lining. The external profile has an outer dimension constant along the second length of the rotor. The rotor defines a plurality of sealed stage cavities with the stator lining. With the first torque imparted from the drive toward the uphole end, the rotor is rotatable in the stator lining and progresses the fluid in the sealed stage cavities from the downhole end to the uphole end. The device is subjected to a reactive torque generating heat toward the uphole end of the stator lining. The first portion of the stator lining at least has a first interference fit with the rotor that is greater than a second interference fit of the second portion of the stator lining with the rotor. This non-uniform engagement or interference fit can evenly load pressure across all of the working stages in the device and can distribute the torque and heat evenly across the device, resulting in maintaining better material properties of the stator lining, providing more efficient use of the power section, and extending the life of the power section.

According to the present disclosure, a method of constructing a progressing cavity device involves forming an elastomeric stator lining in a bore of a metallic housing having first and second ends by defining a first portion of an internal passage of the elastomeric stator lining toward the first end of the metallic housing with a first internal dimension that is less than a second internal dimension of at least a second portion of the internal passage toward the second end of the metallic housing. A metallic rotor is formed having an outer dimension constant along a second length of the rotor. The metallic rotor is disposed in the internal passage of the elastomeric stator lining with a first interference fit between the first portion and the rotor being tighter than a second interference fit between the second portion and the rotor.

Forming the elastomeric stator lining in the bore of the metallic housing can include forming the elastomeric stator lining in the bore by defining a first section of the elastomeric stator lining toward the first end of the metallic housing with a first stiffness being greater than a second stiffness of at least a second portion of the stator lining toward the second end of the metallic housing.

According to the present disclosure, a progressing cavity device comprises a housing, a stator lining, and a rotor. The housing has first and second ends and defines a bore therethrough. The stator lining is disposed in the bore of the housing and defines an internal passage along a first length of the stator lining. The stator lining is composed of an elastomeric material at least having a first section toward the first end of the housing with a first stiffness that is greater than a second stiffness of at least a second section toward the second end of the housing. The rotor is disposed in the internal passage for rotation therein.

In a further arrangement, the internal passage can include a first portion toward the first end of the housing with a first internal dimension that is less than a second internal dimension of at least a second portion toward the second end of the housing. The rotor can have an outer dimension constant along a second length of the rotor. The rotor at least has a first interference fit with the first portion that is tighter than a second interference fit with the second portion.

The foregoing summary is not intended to summarize each potential embodiment or every aspect of the present disclosure.

DETAILED DESCRIPTION OF THE DISCLOSURE

A progressing cavity device of the present disclosure can be used in oil field applications to pump fluids or to drive downhole equipment in the wellbore. The device has two helical gears with an inner gear (rotor) typically rotated within an outer gear (stator), although other rotational arrangements are possible, such as a reverse arrangement. The outer gear (stator) has one helical thread or lobe more than the inner gear (rotor). In general, the device can operate as a motor through which pumped fluids flow to rotate the inner gear (rotor) within the outer gear (stator) to produce torque of a drive, such as an output shaft, transmission shaft, universal joint, or the like coupled to a cutting tool, an end mill, or a drill bit.

Figure 1:
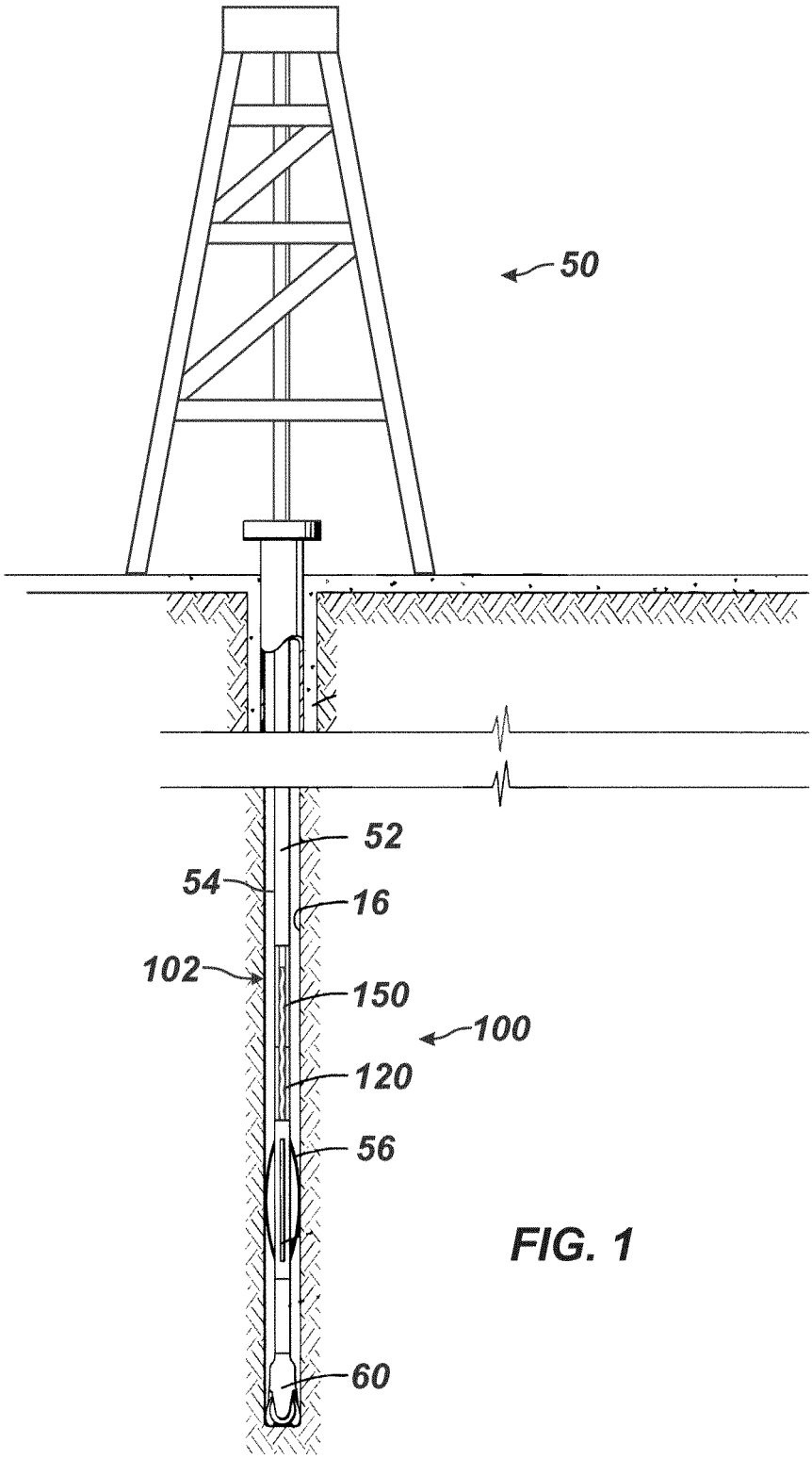
FIG. 1 illustrates a progressing cavity device deployed downhole in a wellbore as a progressing cavity motor.

As shown in FIG. 1, for example, the progressing cavity device 100 can be used as a progressing cavity motor or positive displacement motor to drive a tool 60, such as a cutting tool, an end mill, or a drill bit, of a drilling assembly 50, which can include a drilling rig, coiled tubing equipment, etc. The device 100 can be disposed downhole in a borehole 16 with a tubular 52 (e.g., drillstring, coiled tubing, or the like). In general, a position measuring device 54, such as a measurement-while-drilling (MWD) tool, can be coupled to the tubular 52, and a stabilizer sub 56 can be coupled to the device 100 to maintain alignment of the components within the wellbore 16. The tool 60 coupled to the assembly 50 can include, for example, a drill bit to drill the wellbore 16.

Drilling fluid is pumped down the tubular 52 to the device 100, causing an inner gear or rotor 150 to rotate relative to an outer gear or stator lining 120. This rotates the drill bit 60 coupled to the rotor 150. In some applications, the tubular 52 may also be rotated to additionally rotate the drill bit 60 by also rotating the device 100.

Figure 2A:
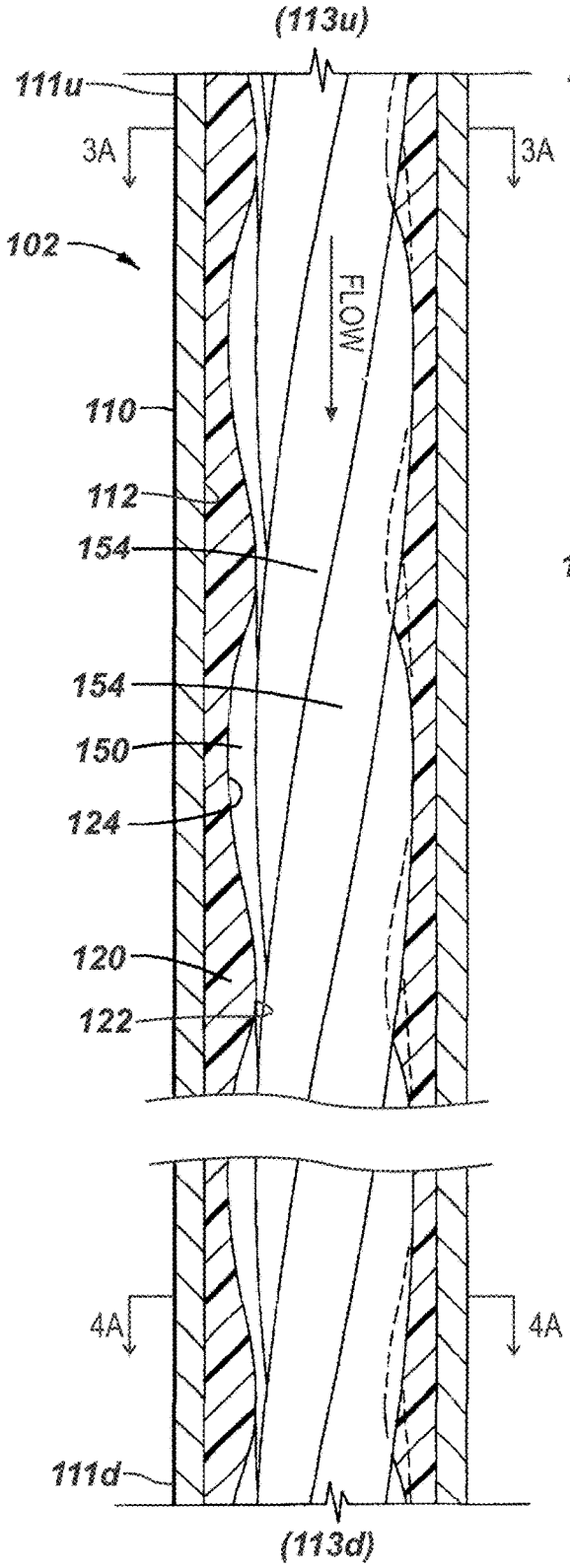
FIGS. 2A-2B schematically illustrate cross-sectional views of a power section of the progressing cavity device as in FIG. 1.
Figure 2B:
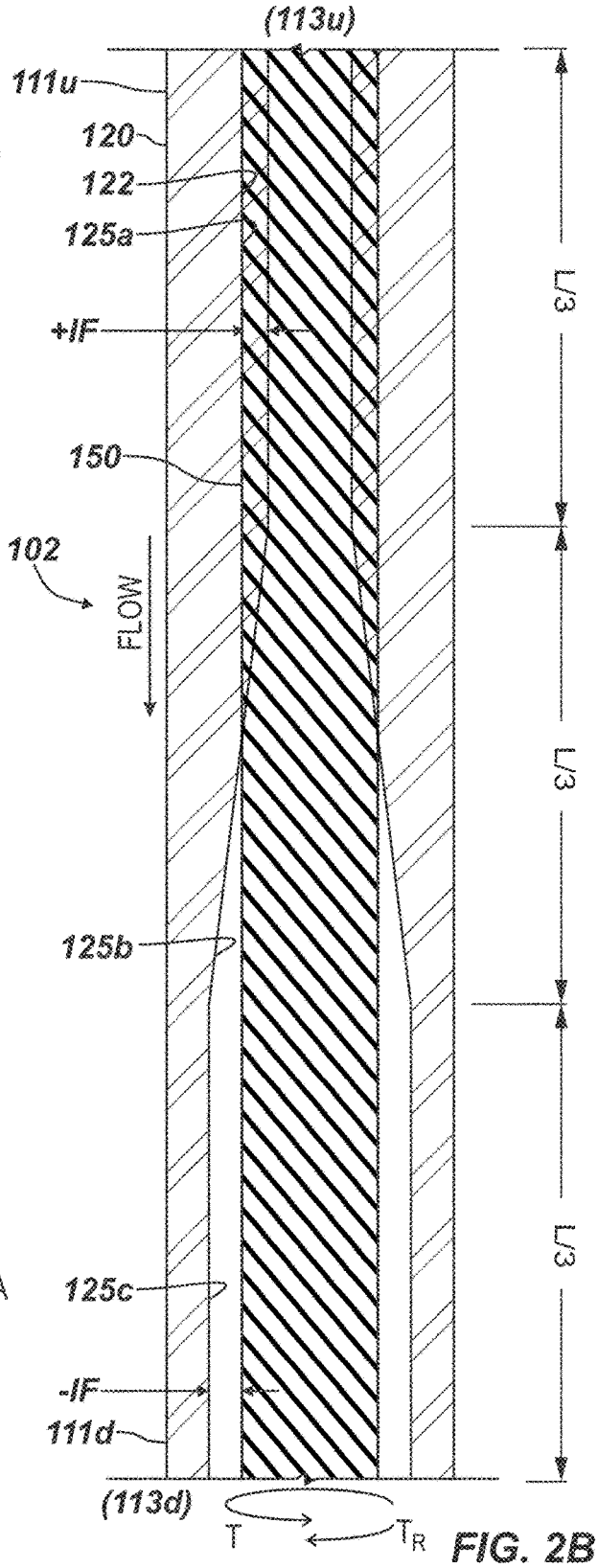

With an understanding of the device 100 operated as a motor in FIG. 1, discussion now turns to particulars of the power section 102 of the device 100. FIG. 2A illustrates part of the progressing cavity device 100 in partial cross-section, while FIG. 2B illustrates a schematic of the stator lining 120 and the rotor 150 of the device 100 in cross-section.

As depicted, the power section 102 of the device 100 has a housing 110, the stator lining 120, and the rotor 150. (Typically, the term "stator" is used to refer to the entire assembly of the cylindrical housing along with the elastomer lining formed inside. In the present disclosure, the term "stator" can also have this meaning. In context, the "stator" of the disclosed power section 102 is described as including a housing 110 and a stator lining 120 (i.e., the elastomer having a helical profile) for the purposes of description.) The housing 110 has first and second ends 111*d*, 111*u* and defines a bore 112 therethrough from end-to-end. Typically, the housing 110 is composed of a metallic material. The first end 111*u* of the housing 110 can be uphole, while the second end 111*d* of the housing 110 can be downhole.

The stator lining 120 is disposed in the bore 112 of the housing 110 and defines an internal passage 122 along a length of the stator lining 120. The stator lining 120 is comprised of an elastomeric material formed inside the housing's bore 112. In general, the internal passage 122 of the stator lining 120 can have a stator profile 124 formed internally thereon, which defines a plurality of lobes 124 spiraling along a length of the stator lining 120 in one or more stages.

The rotor 150 is disposed in the internal passage 122 of the stator lining 120 for rotation therein. In general, the rotor 150 can have a rotor profile 154 formed externally thereon, which defines a plurality of lobes, teeth, or splines 154 spiraling along the rotor's length. The stator profile 124 includes one more lobe than the rotor profile 154, and the profiles 124, 154 can define one or more stages along the length of the device 100. Thus, the lobes 154 of the rotor 150 also spiral along the longitudinal length in the one or more stages.

For example, the lobes 154 can be formed in a helical thread pattern around the circumference of the rotor 150, and the lobes 124 can be formed in a helical thread pattern around the circumference of the stator lining 120 for receiving the rotor's lobes 154. The number of lobes 154 is less than the number of lobes 124, and the two are mated together. For example, the stator lining 120 may include one more lobe 124 than the number of lobes 154 on the rotor 150.

Overall, the rotor lobes 154 may be produced with matching profiles and having a rotor pitch suited to the stator pitch. The rotor 150 matched to and inserted within the stator lining 120 forms cavities (not shown) between each rotor lobe 154 and corresponding stator lobe 124 as the rotor 150 rotates. The number of times that such a cavity spirals around 360-degrees along the length of the device 100 defines the number of stages, which determines the amount of differential pressure across the device 100.

Operated as a motor, pumped drilling fluid can be pumped at high pressure from a tubular, a drillstring, or a coiled tubing in fluid communication with the inlet end 111*u* and can discharge from the outlet end 111*d*, which can be in fluid communication with a drill bit. Typically, the rotor 150 at the uphole end 111*u* can orbit uncoupled to other components. In general, for example, a rotor catch at the upper end of the rotor 150 may be used to catch against a shoulder should components of the housing 110 and bottom hole assembly become separated. By contrast, the rotor 150 at the downhole end 111*d* couples to a drive (not shown), such as a transmission shaft, output shaft, universal joints, etc., as typically found in a drilling motor.

Typically, reduced clearance is used between the stator lining 120 and rotor 150 to reduce leakage and loss in efficiency. The rotor 150 flexibly engages the elastomeric stator lining 120 as the rotor 150 turns within the stator lining 120 to effect a seal therebetween. The amount of flexible engagement can be referred to as a compression or interference fit.

In general according to the present disclosure, the stator lining 120 and the rotor 150 define a first engagement at a first portion toward one end that is greater than a second engagement with a second portion toward the other end. In one configuration, for example, the first engagement comprises a first interference fit between the stator's internal dimension at the first portion (e.g., toward upper end 111*u*) with the rotor 150 that is tighter than a second interference fit for the second engagement between the stator's internal dimension at the second portion (e.g., toward lower end 111*d*) with the rotor 150. An example of this is depicted in FIG. 2B.

In another configuration, the first engagement comprises a first stiffness/hardness between the first portion (e.g., toward upper end 111*u*) of the stator lining 120 with the rotor 150 that is greater than a second stiffness/hardness for the second engagement between the second portion (e.g., toward lower end 111*d*) of the stator lining 120 with the rotor 150. The different stiffness/hardness can be obtained using sections of the stator lining 120 having different elastomers. An example of this will be discussed later with respect to FIG. 7.

Yet another configuration combines the previous two forms of engagement. Accordingly, the first interference fit between the internal dimension at the first portion (e.g., toward upper end 111*u*) of the stator lining 120 with the rotor 150 can be tighter than the second interference fit between the internal dimension at the second portion (e.g., toward lower end 111*d*) of the stator lining 120 with the rotor 150, while the first stiffness/hardness between the first portion (e.g., toward upper end 111*u*) of the stator lining 120 with the rotor 150 can also be greater than the second stiffness/hardness for the second engagement between the second portion (e.g., toward lower end 111*d*) of the stator lining 120 with the rotor 150.

As noted herein, the stages refer to the sealed cavities formed between the rotor 150 and stator lining 120. In particular, the compressive fit between the rotor 150 and elastomeric stator lining 120 produces seals where the rotor 150 contacts the stator lining 120. The seals separate individual cavities, which can progress through the power section 102 with each revolution of the rotor 150. The set of seals formed in one pitch length of the stator lining 120 constitutes one stage. The differential pressure of the progressing cavity device 100 is determined by the number of stages it has—i.e., a two stage device has twice the differential pressure capability compared to a single stage device and so on.

For the motor as in FIGS. 2A-2B, the cavities formed between the rotor 150 and the stator lining 120 progress from an intake (high pressure) end 111*u* of the device 100 to an outlet (low pressure) end 111*d* of the device 100 as the rotor 150 is turned (i.e., by the flow of pumped drilling fluid) within the stator 150.

As noted above in reference to FIG. 2B, the specific "fit" or "engagement" in one configuration, such as for a motor, can include a non-uniform internal fit or engagement between the stator lining 120 and the rotor 150 in which the stator lining 120 has less interference (more clearance) at the downhole end 111*d* and has more interference (less clearance) at the uphole end 111*u*. This non-uniform engagement can evenly load the pressure across all working stages in the power section 102 and can distribute the torque and heat evenly across the power section 102, resulting in maintaining better material properties of the stator lining 120, providing more efficient use of the power section 102, and extending the life of the power section 102.

Control of the load balancing can be enhanced by optimizing the fit geometry specifically for the design requirements for the power section 102. As also noted above but discussed later, the even distribution of pressure load, torque, and heat can be enhanced by injecting the stator lining 120 with a plurality of elastomers from the same family, but with different thermal expansion properties to produce the non-uniform engagement.

The interference or compression fit for a given implementation can be configured as needed to meet operational requirements, temperatures, pressure loads, torques, fluid properties, etc. For instance, the interference or compression fit can be configured to produce a rate of elastomer thermal expansion that can be characterized from instrumented dyno tests that record pressure contribution per stage, temperature per stage, and rate of temperature change per stage. The measured information can then help set up the configuration with a specific "fit" or "engagement" (e.g., interference fit, compression fit, clearance, stiffness, hardness) between the rotor 150 and stator lining 120 to operate at particular temperatures, flow rates, and differential pressures to be experienced during operation in a given implementation.

The elastomer stator lining 120 in the housing 110 can be configured according to the present disclosure when first manufactured. Additionally, the original elastomer stator lining 120 would typically be removed after repeated use, and a new elastomer stator lining 120 would be relined inside the housing 110. Such a relined stator lining 120 can be configured according to the present disclosure, even though the previous stator lining 120 was not. This can allow the profile and performance of a power section 102 to be modified during the repair and maintenance cycle of the device 100 and can enable the power section 102 to be configured for different requirements between uses.

According to the present disclosure, the stator lining 120 has a non-uniform longitudinal bore 122 in which the rotor 150 is disposed so that the compression or interference fit is varied along the length of the device 100. In particular, the rotor 150 has a constant or uniform outer diameter along its length, but the stator lining 120 has an inner diameter that is not uniform along the length of the stator's longitudinal bore 122 so that the fit/clearance between the rotor 150 and stator lining 120 changes from a tighter fit/smaller clearance at the uphole end 111*u* to a looser fit/larger clearance at the downhole end 111*d* of the device 100.

As best shown in FIG. 2B, the internal passage 122 at least has a first portion toward the first end 111*u* of the housing 110 with a first internal dimension being less than a second internal dimension of at least a second portion toward the second end 111*d* of the housing 110. The rotor 150, however, has an outer dimension constant along a length of the rotor 150. The rotor 150 disposed in the internal passage 122 for rotation in the stator lining 120 thereby at least has a first interference fit (+IF), compression fit, or engagement with the stator's first portion that is tighter than a second interference fit (−IF), compression fit, or engagement with the stator's second portion.

As particularly shown in FIG. 2B, the device 100 has three sections dividing the length (L) of the device 100 into thirds (L/3). A number of stages may be defined along the length (L) of the device 100, and each section (L/3) can have part of a stage or can encompass one stage or more than one stage. Each section (L/3) encompasses the same number of stages, but other variations are possible. For example, a ten stage power section 10 can have its ten stages divided equally for the three sections.

In this arrangement, the internal passage 122 at least has a first portion 125*a* toward the first end 111*u* of the housing 110 with a first internal dimension being less than a second internal dimension of at least a second portion 125*c* toward the second end 111*d* of the housing 110. An intermediate portion 125*b* of the internal passage 122 tapers outward from the first portion 125*a* to the second portion 125*b*. The rotor 150, however, has an outer dimension constant along the length of the rotor 150. Again, the rotor 150 disposed in the internal passage 122 for rotation in the stator lining 120 at least has a first interference fit (+IF), compression fit, or engagement with the stator's first portion that is tighter than a second interference fit (−IF), compression fit, or engagement with the stator's second portion.

Generally, the housing 110 and the rotor 150 are made of metallic material, such as a stainless steel, while the stator lining 120 is composed of an elastomeric material. The elastomeric material can be a rubber, Buna-N, nitrile-based elastomer, fluoro-based elastomer, Teflon™, silicone, plastic, other elastomeric material or combination thereof. The hardness of the elastomer can be chosen for the particular implementation. An elastomer with increased hardness can be used. Additionally or in the alternative, an elastomer with reduced thermal expansion can be used. The selection of the elastomer can thereby control the interference fit and/or any increase in interference that could be caused by an increase in heat generated by the power section 102. For example, an elastomer having a hardness of about 90 durometer could be used to reduce thermal expansion. Other materials for the housing 110, the rotor 150, and the stator lining 120 could be used.

With the device 100 of FIGS. 2A-2B operated as a motor, the uphole fluid inlet 113*u* of the device 100 receives pumped fluid from surface, typically delivered through a tubular, drillstring, coiled tubing, etc. The pumped fluid turns the rotor 150 in the stator lining 120 to produce torque (T), and the fluid eventually passes out the downhole fluid outlet 113*d* at the downhole end 111*d*. A coupling (not shown) of the rotor 150 at the downhole end 111*d* couples to a drive, such as an output shaft, a transmission shaft, a universal joint, etc., which transfers the generated torque (T) to a cutting tool, a drill bit, or the like to be driven with the pumped fluid turning the rotor 150. (Details of such a coupling can be found in U.S. Pat. Nos. 6,358,027 and 6,457,958, which are incorporated herein by reference.)

A reactive torque ($T_R$) counters the generated torque (T). The reactive torque ($T_R$) can come from the drill bit engaged against a formation being drilling and can come from counter-rotation placed on the stator lining 120 by the pumped drilling fluid. For example, the pumped drilling fluid pushing against the stator lining 120 may tend to twist the power section 102 anti-clockwise. The drill bit engaged with weight-on-bit during drilling can then directly increase this reactive torque ($T_R$).

As a result, the stage of the device 100 closest to the drill bit or other cutting tool on the power section 102 (i.e., bottom stage near the downhole end 111*d*) carries a maximum load until the fluid slips and is taken up by the stage above it. This carrying of the load follows up the multiple stages of the power section 102.

The work involved generates heat in the stages of the power section 102. Because most of the work (through the reactive torque ($T_R$)) in the power section 102 is performed in the bottom stages while drilling or during circulation, the bottom of the power section 102 generates more heat. Yet, the different interference fit (−IF) for the lower portion (i.e., one or more lower stages) of the power section 102 as disclosed herein can thereby counteract or reduce the effects of generated heat, such as the weakening of the elastomer material properties and possible damage to the stator lining 120.

Figure 3A:
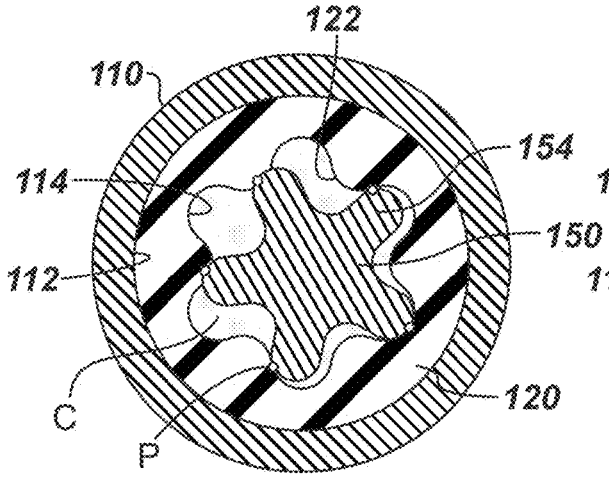
FIG. 3A schematically illustrates an end-sectional view of the power section of the device shown in FIG. 2A at section 3A.
Figure 4A:
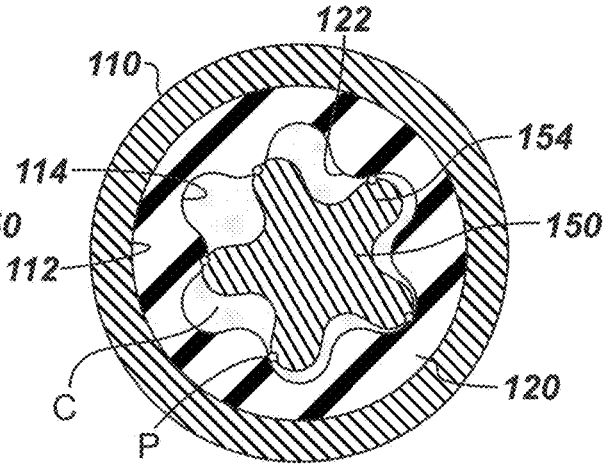
FIG. 4A schematically illustrates an end-sectional view of the power section of the device shown in FIG. 2A at section 4A.
Figure 3B:
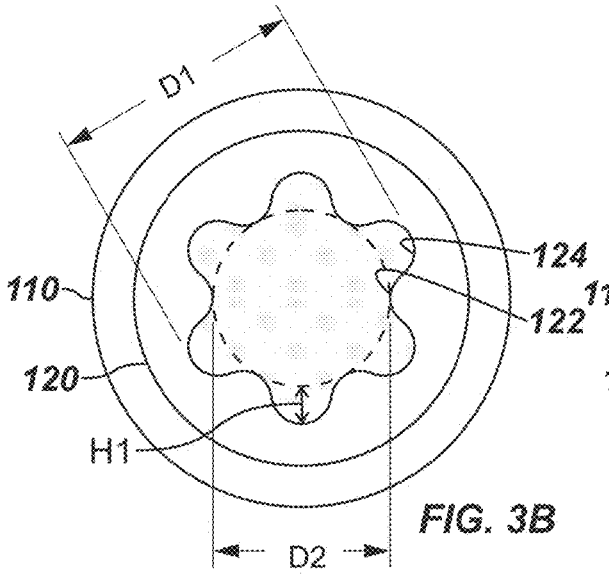
FIG. 3B schematically illustrates diameters of the stator shown in FIG. 3A.
Figure 4B:
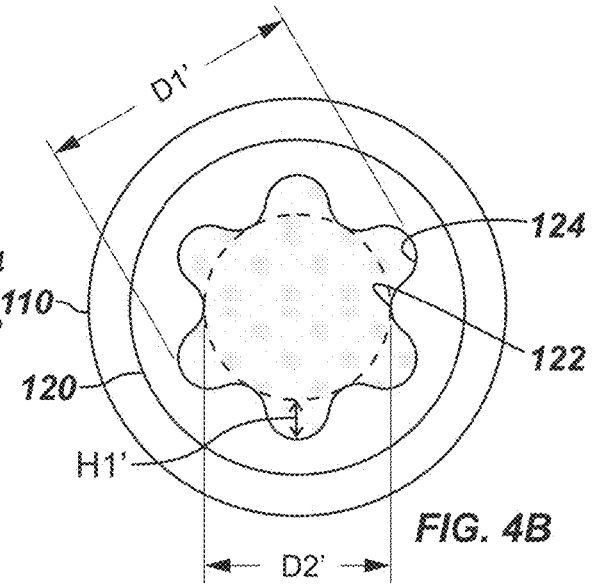
FIG. 4B schematically illustrates diameters of the stator shown in FIG. 4A.
Figure 3C:
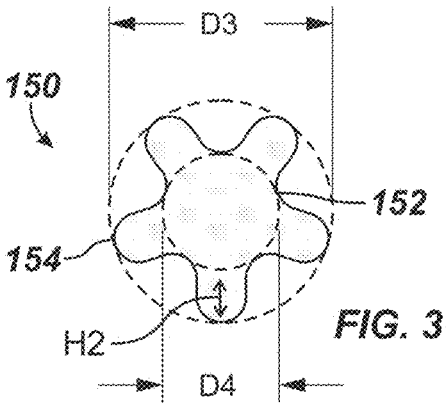
FIG. 3C schematically illustrates diameters of the rotor shown in FIG. 3A.
Figure 4C:
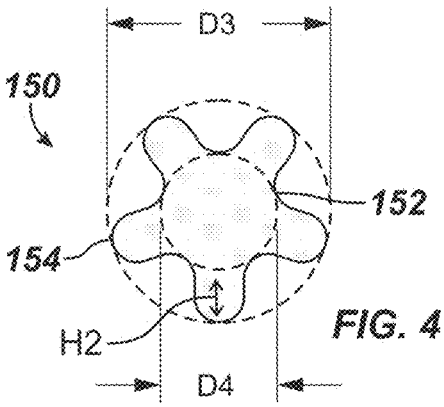
FIG. 4C schematically illustrates diameters of the rotor shown in FIG. 4A.

With an understanding of the device 100, the power section 102, and their use and operation, discussion turns to some of the geometric details. FIG. 3A is an end-section of the device's power section 102 shown in FIG. 2A at section 3A toward the uphole end 111*u*, revealing one arrangement of stator lobes 124 and rotor lobes 154. FIG. 3B is a schematic view of diameters of the stator lining 120 shown in FIG. 3A, and FIG. 3C is a schematic view of diameters of the rotor shown in FIG. 3A. By contrast, FIG. 4A is an end section of the device's power section 102 shown in FIG. 2A at section 4A toward the downhole end 111*d*. FIG. 4B is a schematic view of diameters of the stator lining 120 shown in FIG. 4A, and FIG. 4C is a schematic view of diameters of the rotor 150 shown in FIG. 4A.

As shown, the rotor 150, which has five lobes/teeth 154, is disposed within the stator lining 120, which has six lobes/grooves 124 in this example. The elastomeric stator lining 120 engages the rotor 150 as the rotor 150 rotates within the stator lining 120. For example, the rotor 120 engages the elastomeric stator lining 120 at five points P, generally forming an interference fit with the elastomer stator 150 and producing five cavities C. Other arrangements with different number of lobes, stators, engagement points, and cavities can be used.

As shown in FIG. 3B, the stator lining 120 toward the uphole end has a first minor diameter D2, a first major diameter D1, and a resulting first thread height H1. As used herein, the major diameter refers to the dimension from crest to crest, whereas the minor diameter refers to the circular cross-section. As shown in FIG. 3C, the rotor 150 toward the uphole end has a minor diameter D3, a major diameter D4, and a resulting thread height H2.

As shown in contrast in FIG. 4B, the stator lining 120 toward the downhole end has a second minor diameter D2', a second major diameter D1', and a resulting second thread height H1'. Consistent with the configuration in FIG. 2B, the second major and minor diameters D1', D2' toward the downhole end are greater than the first major and minor diameters D1, D2 toward the uphole end. For its part, the rotor 150 as shown in FIG. 4C toward the downhole end has the same (or substantially the same within tolerances) minor diameter D3, major diameter D4, and resulting thread height H2 as found at the uphole end.

As a result, the interference or compression fit at the engagement points P between the rotor 150 and stator lining 120 at the uphole end (as in FIG. 3A) is tighter or greater than the fit at the engagement points P between the rotor 150 and stator lining 120 at the downhole end (as in FIG. 4A).

In general, the rotor 150 and/or stator lining 120 can have a relatively constant thread height—i.e., the height of the threads may be the same along the length of the device's power section 102. Thus, the heights H1, H1' at the uphole and downhole ends can be the same (or substantially the same within tolerances). Other variations are possible. For example, the thread height H1 toward the uphole end may be greater or smaller than the thread height H1' near the downhole end, while still achieving the non-uniform interference/compression fit of the present disclosure.

For the purposes of further characterization, the dimensions D3, D4 of the rotor 150 can be defined as the rotor major ($R_M$) and rotor minor ($R_m$) respectively. A rotor mean ($R_{mean}$) can then be characterized by:

$$R_{mean} = \left(\frac{R_M + R_m}{2}\right).$$

The major and minor dimensions D1, D2 of the stator lining 120 can be defined as the stator major ($S_M$) and stator minor ($S_m$), respectively. The resulting compression or interference fit between the rotor 150 and stator lining 120 can be characterized by:

$$\text{interference fit} = \pm(R_{mean} - S_m).$$

In this sense, "+ interference fit" refers to compression or interference, and "− interference fit" refers to clearance. In one particular example for a progressing cavity device 100 used as a motor as in FIGS. 1 and 2A-2B, the upper section (L/3) of the stator/rotor can have a +0.025-in. interference fit, the middle section (L/3) of the stator/rotor can taper from a +0.025-in. interference fit to a −0.010-in. interference fit, and the lower section (L/3) of the stator/rotor can have a −0.010-in. interference fit. These particular values for the interference fit can be suitable for a motor having a housing 110 with a diameter of about 4-in. and having a rotor with a diameter of about 3-in.

For a field application of a progressing cavity motor, the configuration for a stator/rotor combination according to the present disclosure may be targeted to produce a drop in RPM that would be that same as an existing fit of a standard stator/rotor combination. Additionally or in the alternative, the configuration for a stator/rotor combination may be targeted to produce torque output to be the same as an existing stator/rotor combination. To achieve this, the top (uphole) stage can generate the same RPM drop, while the bottom (downhole) stage can have less temperature build-up, which would result in less softening of the stator and stable torque. The effects of angular deflection of the rotor 150 may be considered negligible for the present discussion.

Figure 5A:
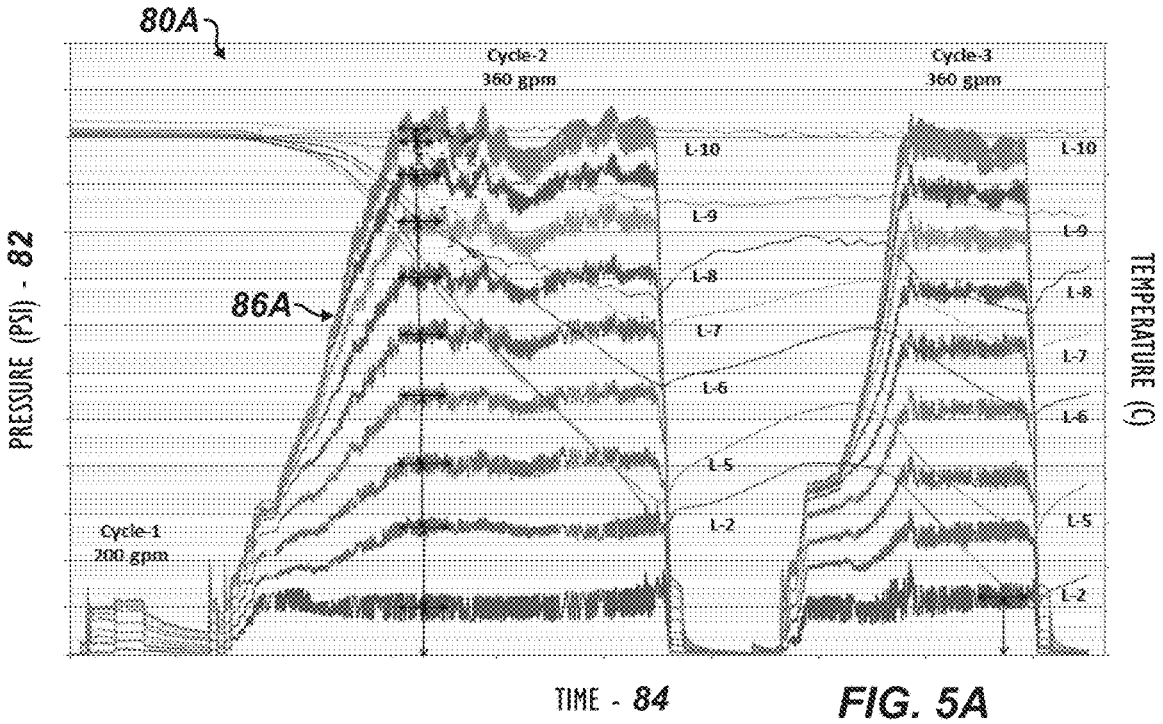
FIG. 5A (PRIOR ART)
FIGS. 5A, 5B, and 5C illustrate graphs of pressure differential and temperature distribution from dyno testing of an existing power section having a conventional stator/rotor combination.
Figure 5B:
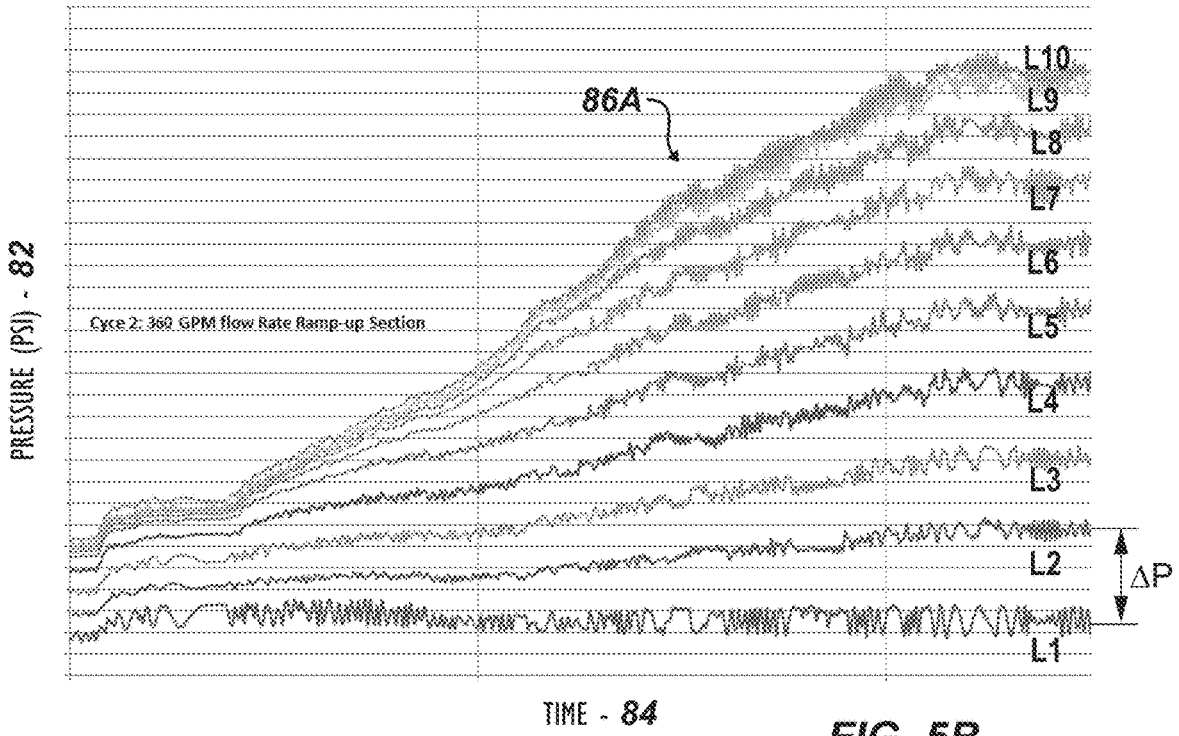
FIG. 5B (PRIOR ART)

For comparative purposes, FIGS. 5A and 5B illustrate pressure distribution for cycles of an existing stator/rotor combination in a progressing cavity motor obtained from dyno testing at each of ten stage locations. As seen in FIG. 5A, the graph shows curves 80A for the ten stage locations in the cycles plotted as pressure 82 (*psi*) versus time 84. The ramp-up section 86A of the second cycle (Cycle-2) is shown in isolated detail in FIG. 5B. The fanning out of the curves 80A for the stage locations (as especially seen in the ramp-up section 86A) indicates that the existing stator/rotor combination has uneven pressure distribution per stage.

Figure 5C:
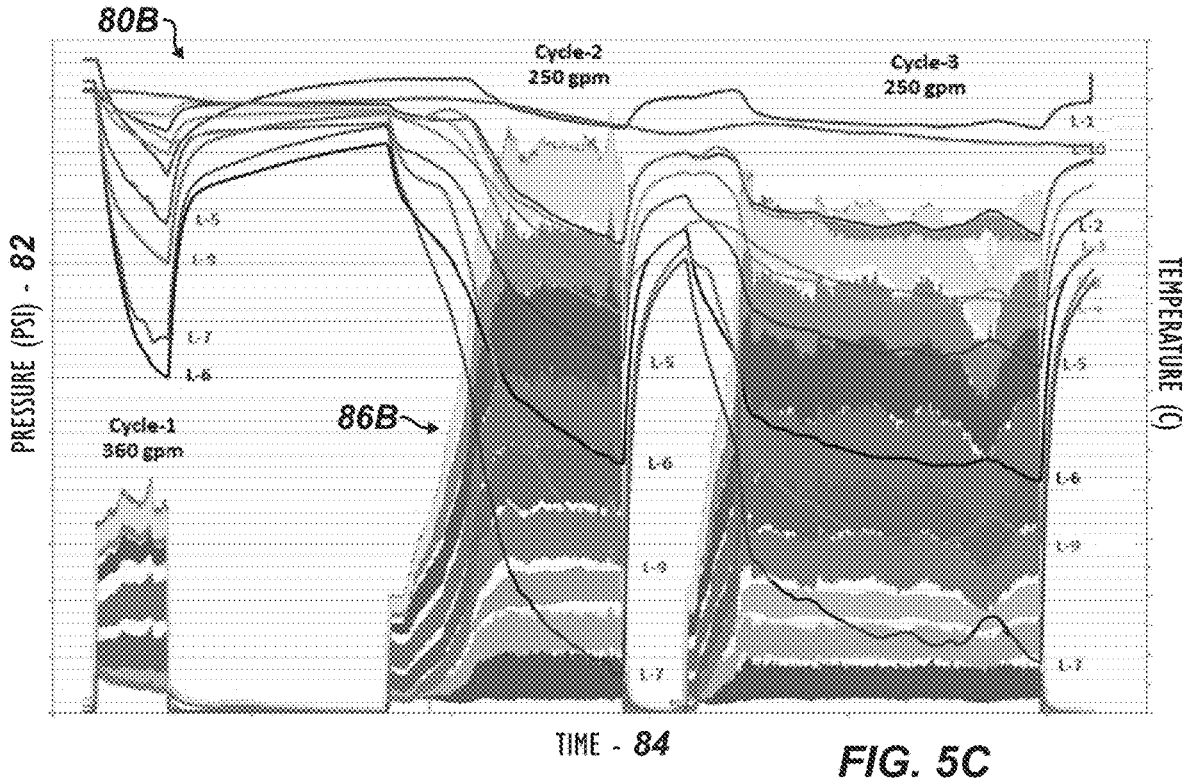
FIG. 5C (PRIOR ART)

In the fully loaded conventional power section, the bottom stages are subjected to a higher pressure differential (ΔP), and the differential ΔP gradually decreases towards the top stages including in the ramp-up section. As the graph 90A for the conventional power section in FIG. 5C shows, the pressure differential (ΔP) from FIG. 5B is plotted as pressure differential 92 from stage to stage 94. The trendline 96A of pressure differential (ΔP) decreases (has negative slope) from the bottom end (stage L1, L2, . . . ) to the top end (stage L10, L9, . . . ) of the power section in the progressing cavity motor.

Figure 5F:
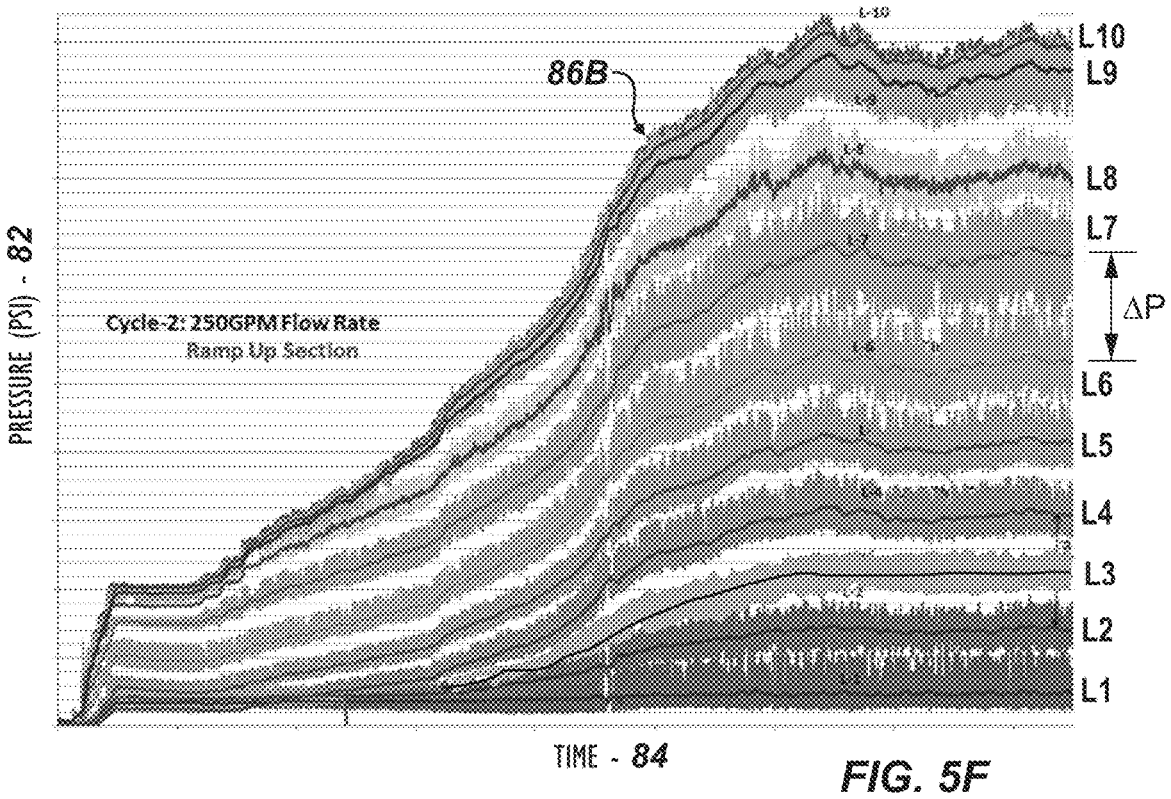
FIGS. 5D, 5E, and 5F illustrates a graph of pressure and temperature distribution from dyno testing of a disclosed power section at each of ten stage locations.
Figure 5D:
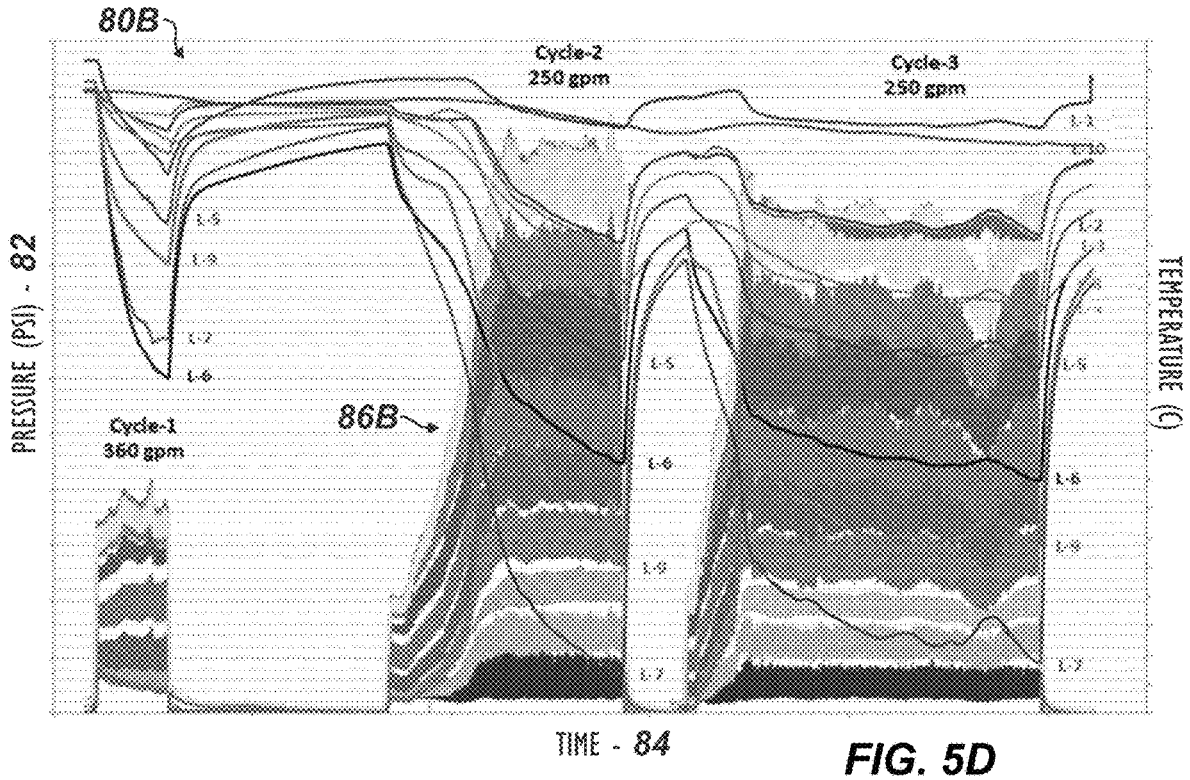
Figure 5E:
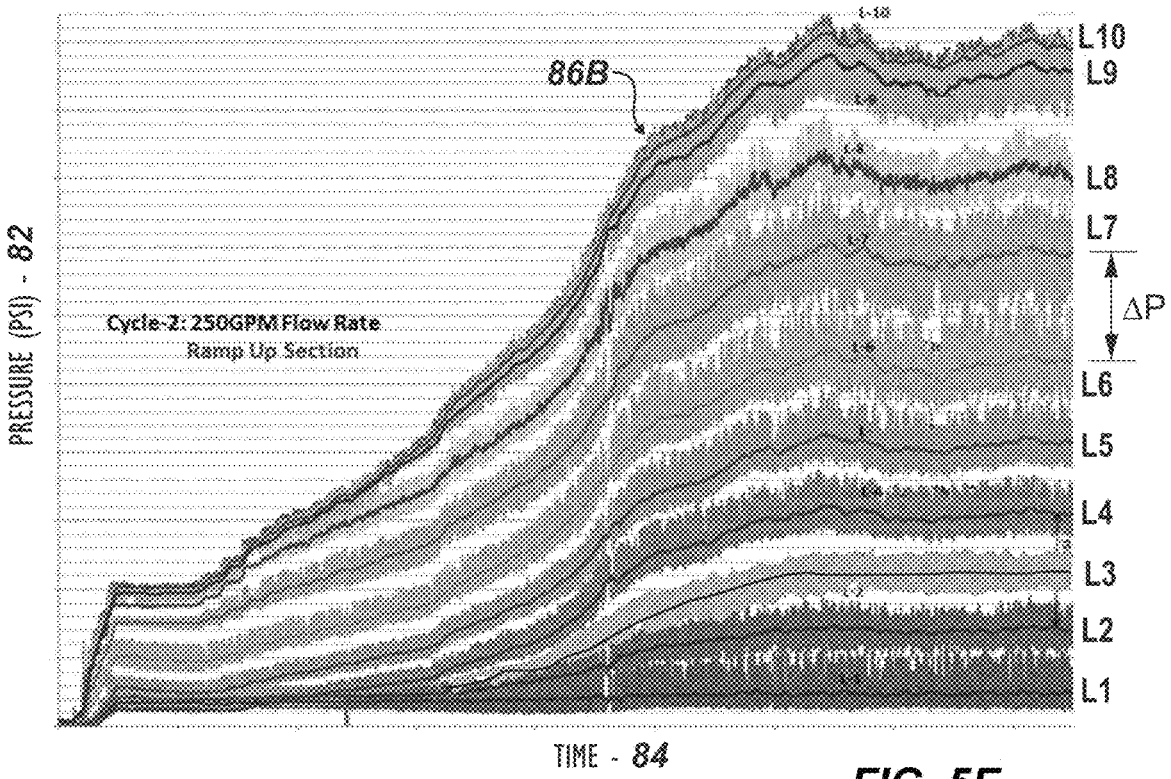

By contrast, FIGS. 5D and 5E illustrate pressure distribution for cycles of the disclosed power section 102 in a progressing cavity motor obtained from dyno testing at each of ten stage locations. As shown, the arrangement in accordance with the present disclosure can produce a load balanced pressure distribution per stage. As seen in FIG. 5D, for example, the graph shows curves 80B for ten stage locations in the cycles plotted as pressure 82 (psi) versus time 84. The ramp-up section 86B of the second cycle (Cycle-2) is shown in isolated detail in FIG. 5E. Instead of fanning out, the curves 80B for the stage locations stack one pressure on top of the other, indicating load balancing of the pressure distribution.

Instead of the pressure differential decreasing from the bottom end (stage L1, L2, . . . ) to the top end (stage L10, L9, . . . ) as in the conventional arrangement, the load-balanced power section 102 of the present disclosure has the top stages (e.g., L10, L9, . . . ) subjected to a higher pressure differential than the bottom stages (e.g., L1, L2, . . . ) as visible in ramp-up section 86B of FIG. 5E. As the bit load increases, however, the bottom stages also start to carry pressure differential, and the load along the power section's length in each stages starts to balance out. As the graph 90B of the disclosed power section 102 in FIG. 5F shows, the trendline 96B of the pressure differential (ΔP) increases (has a positive slope) from bottom end (stage L1) to top end (stage L10) of the power section 102.

As can be seen, the disclosed power section 102 can have its pressure differential (and dependent variable temperature) configured along the power section's length to best suit a particular implementation. In one configuration, for example, the power section 102 can be configured to equally distribute the pressure differential load among all of the stages. Alternatively, there may be some implementations in which a lower pressure differential in bottom stages than top stages may be desirable instead of having equal load among all stages.

In previous discussions, the stator lining 120 has been described as having at least two sections of different internal dimensions. The particular example in FIG. 2B shows three sections. Other configurations are possible. In particular, FIGS. 6A-6F illustrate examples of stator configurations according to the present disclosure.

As noted above, the stator lining 120 and the rotor 150 in general define a first engagement at a first portion toward the device's first end that is greater than a second engagement with a second portion toward the device's second end. When used as a motor, the first end is uphole, and the second end is downhole. Accordingly, a first interference/compression fit between the stator's internal passage 122 at the uphole portion with the rotor 150 is tighter than a second interference/compression fit between the stator's internal passage 122 at the downhole portion with the rotor 150. The device's length (L) can be divided into two sections (S1, S2), three sections (S1, S2, S3), or even more. As intimated, these sections can be equal divisions of the length (L), thereby encompassing the same number of stages. This may not be strictly necessary, as the various divisions can be unequal segments of the length (L).

Figure 6A:
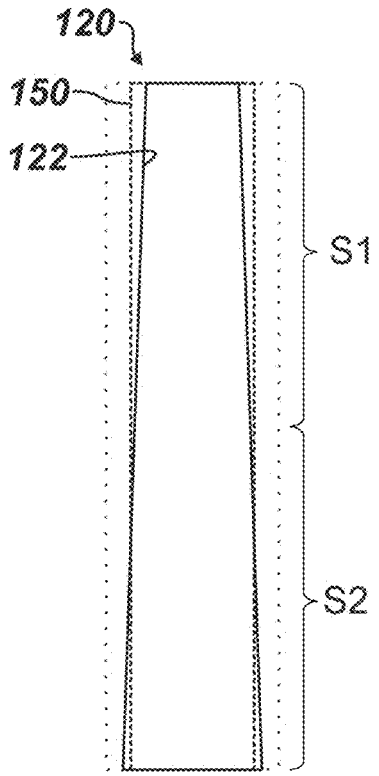
FIGS. 6A-6F illustrate examples of stator configurations according to the present disclosure.

As shown in FIG. 6A, the internal passage 122 of the stator lining 120 tapers at a first increasing angle outward for a first section (S1) at the uphole end and then tapers therefrom at a second increasing angle outward for a second section (S2) at the downhole end. In general, the first and second angles can be the same, but they could also be different with the taper of the second angle being more or less than the first angle. In general, the first and second sections (S1, S2) can each encompass a division (L/2) of half the length of the stator lining 120.

Figure 6B:
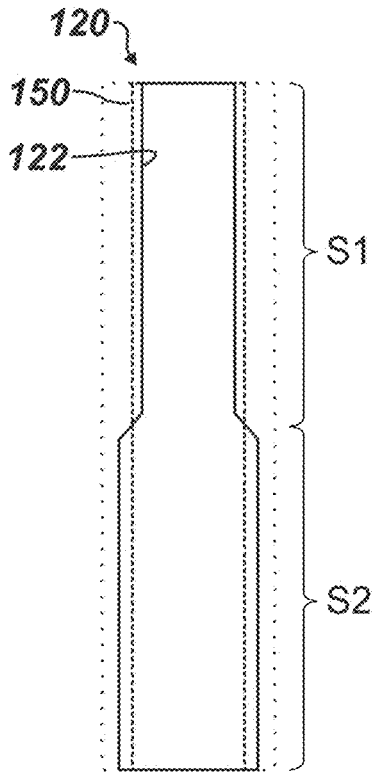

As shown in FIG. 6B, the internal passage 122 of the stator lining 120 for a first section (S1) uphole can be constant at a first internal dimension. The internal passage 122 of the stator lining 120 for a second section (S2) downhole can also be constant, but at a second internal dimension greater than the first dimension. A brief transition, step, or angled section may interconnect the two different dimensions of these two sections (S1, S2).

Figure 6C:
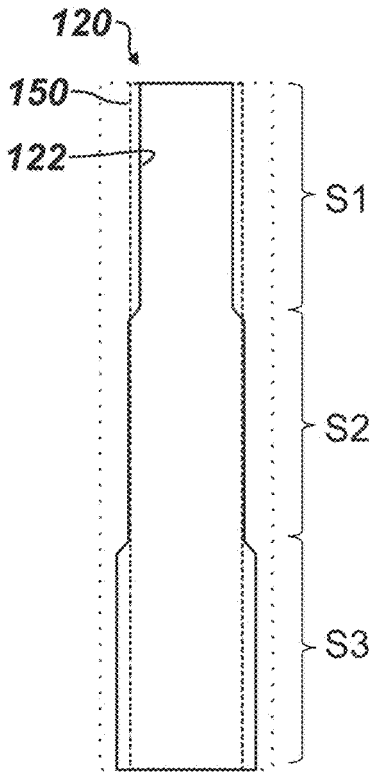

As shown in FIG. 6C, the internal passage 122 of the stator lining 120 has three sections (S1, S2, S3) each encompassing a third (L/3) of the stator's length. Each section (S1, S2, S3) has a constant internal dimension, which increase from the uphole end to the downhole end with transitions from one to the other.

Figure 6D:
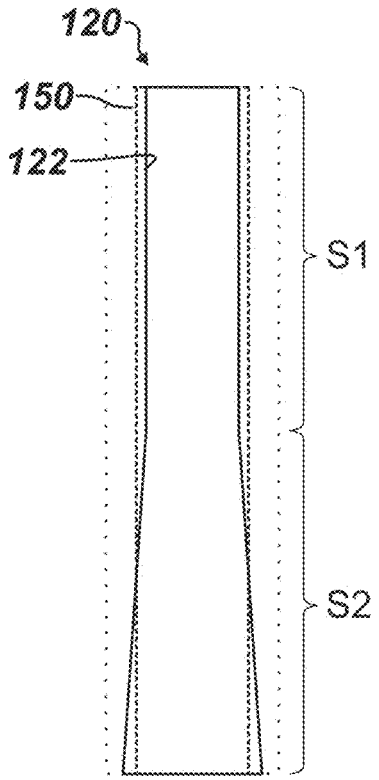
Figure 6E:
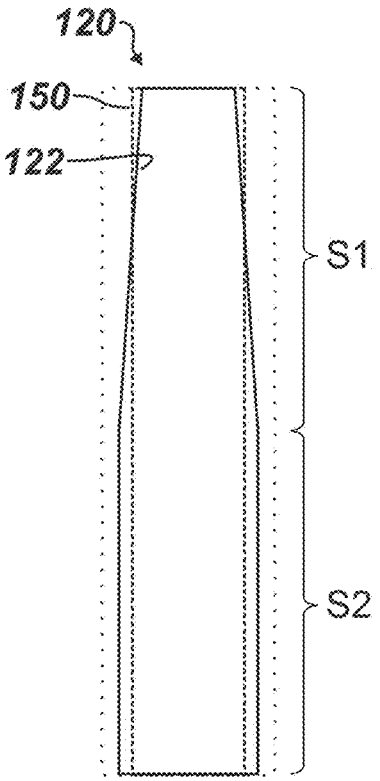

As shown in FIG. 6D, the internal passage 122 is constant along a first section (S1) at the uphole end. From there, the internal passage 122 at a second section (S2) tapers at an increasing angle outward toward the downhole end. As shown in FIG. 6E, the internal passage 122 tapers at an increasing angle outward at a first section (S1) and continues at a constant internal dimension from there for a second section (S2).

Figure 6F:
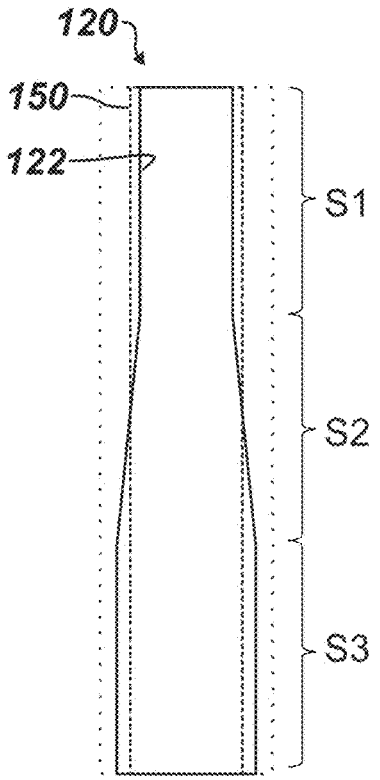

As shown in FIG. 6F, the first internal passage 122 is constant for a first section (S1), tapers therefrom at an increasing angle outward for a second section (S2), and proceeds at a constant internal dimension from there for a third section (S3).

As will be appreciated from these examples, these and other configurations of the internal dimension of the stator's internal passage 122 can vary non-uniformly in two or more sections along the length of the stator lining 120 to meet the desired difference in interference/compression fit from the uphole end to the downhole end for use in a progressing cavity motor. Manufacturing the stator lining 120 inside the housing 110 can use comparable techniques and mechanisms used in forming a conventional stator lining in a housing to form a stator. For example, the stator lining 120 can be formed using injection molding to mold the elastomer in an injection space between the housing 110 and a core member. In general, a computer numerical control (CNC) machine used in the manufacturing process can be programmed to produce the desired sections, transitions, diameters, etc. on the core member in order to produce the desired passage 122 and profile (124) of the stator lining 120 when molded.

As noted previously, the "fit" between the rotor 150 and the stator lining 120 can be configured using different elastomer sections. This can be done alone for the purposes herein or can be combined with the different dimensional configurations detailed previously.

Figure 7:
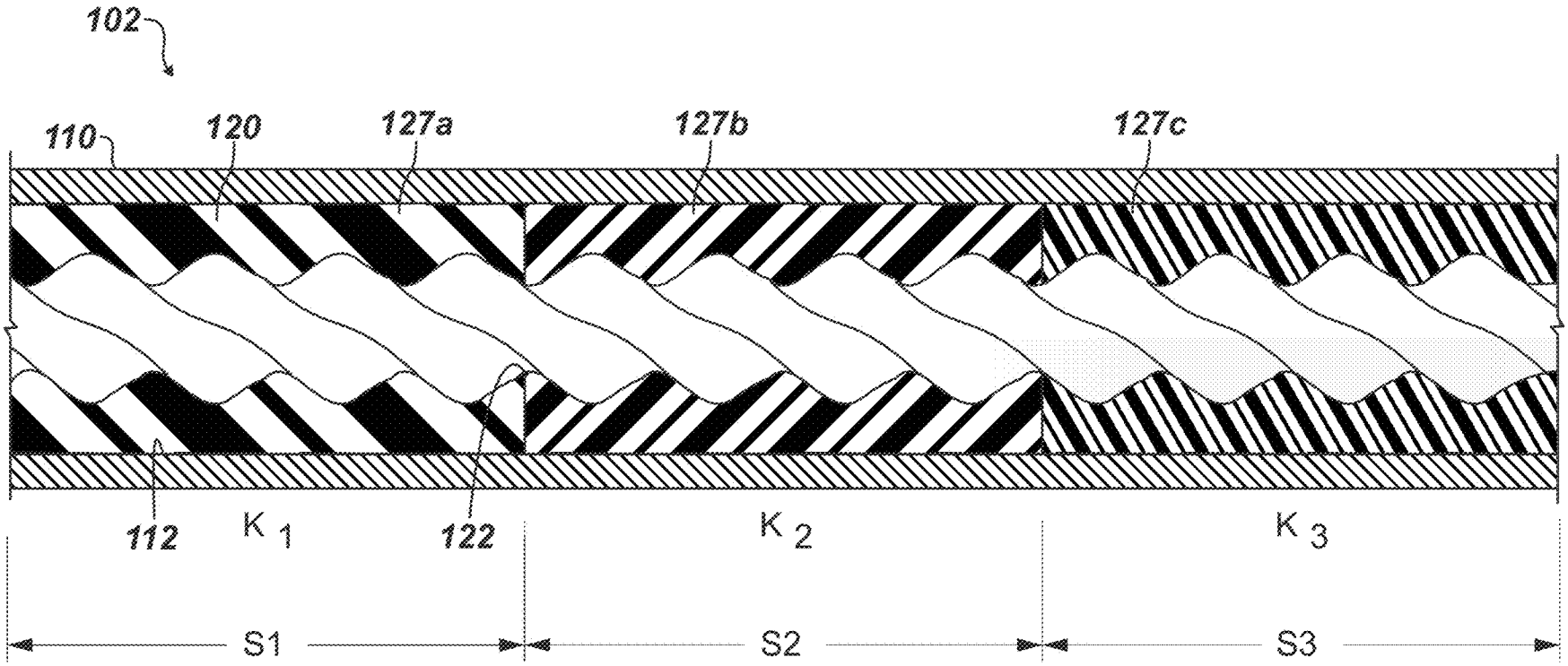
FIG. 7 illustrates another stator configuration according to the present disclosure.

As shown in FIG. 7, a progressing cavity device 100 includes a housing 110, a stator lining 120, and a rotor (not shown), which would position in the stator's internal passage 122. The housing 110, which is metallic, defines a bore 112 therethrough, and the stator lining 120 is disposed in the bore 112 of the housing 110. The stator lining 120 is composed of an elastomeric material at least having a first section (S1) toward a first end of the housing 110 with a first stiffness ($K_1$) being greater than a second stiffness ($K_2$, $K_3$) of at least a second section (S2, S3) toward the second end of the housing 100. For its part, the rotor (not shown) that is disposed in the internal passage 122 for rotation therein can be composed of a metallic material.

As shown, the elastomeric material can have two sections, three sections (S1, S2, S3), or more. The section (S3) further toward the end of the housing 110 can have a third stiffness ($K_3$) being greater than the second stiffness ($K_2$) of the second section (S2). Therefore, the stiffnesses may be defined as $K_1<K_2<K_3$. Such an arrangement may be suited to the purposes disclosed herein, such as when the device 100 is operated as a progressing cavity motor having the stiffest section (S1) at the uphole end. Depending on the implementation, other arrangements of the stiffness can be used either on their own or when combined with the non-uniform internal dimension of the stator's internal passage 122 disclosed previously. Thus, other arrangements can include $K_1>K_2>K_3$; $K_1<K_2>K_3$ with $K_3>K_1$; etc.

In one implementation, the two or more sections (S1, S2, S3) can be equal divisions of the length of the device 100 (encompassing the same number of stages) or can be different from one another to encompass different stages. The two or more sections (S1, S2, S3) can be composed of different elastomers. Alternatively, a first section (S1) can be composed of a first elastomer, while a section (S2) can be made from a mix of that first elastomer with a second elastomer. A third section (S3) can be composed of that second elastomer alone. Other variations are possible where the use of two or more elastomers can be used alone for sections and/or the mix of two or more elastomers can be used together for sections.

In one particular implementation, the device 100 has three sections (S1, S2, S3) as depicted of equal division along the length of the stator lining 120. The first section (S1) can be composed of a first elastomer 127*a* having a first stiffness, while the third section (S3) can be composed of a second elastomer 127*c* having a second stiffness. The intermediate section (S2) can have an elastomer 127*b* composed of a mix of these two elastomers 127*a*, 127*c* to provide an intermediate stiffness.

The particular elastomers 127*a-c* used depend on the stiffness/hardness of the materials and how they can mix. Types of elastomers of interest include nitrile (NBR), Hydrogenated NBR (HNBR), Fluoroelastomer (FKM), and the like, and different formulations of these can be used and suited to the particular implementation and downhole conditions.

The different stiffness or hardness between the sections' elastomers 127*a-c* provide the benefits disclosed herein of reducing the effects of generated heat, such as the weakening of the elastomer material properties and possible damage to the stator lining 120. The different stiffness/hardness can be used alone of other modifications disclosed herein so that the internal passage 122 of the stator lining 120 may be uniform as can the rotor (not shown). Of course, the different stiffness or hardness can be used with other modifications disclosed herein so that the internal passage 122 of the stator lining 120 may be non-uniform while the rotor (not shown) has a constant dimension. Other forms of tapers of the stator and/or rotor could also be used.

As noted above, the elastomer can be selected for offering a different "fit" between the stator lining 120 and the rotor (not shown). This selection can be based on the hardness or stiffness of the elastomer. However, the elastomer can be selected for offering other than just a different "fit." For example, in addition to or instead of the fit, the elastomer could be chosen for offering different rates of thermal expansion, different wear characteristics, etc.

Constructing the progressing cavity device 100 involves an injection molding process of forming the elastomeric material for the stator 150 inside the housing's bore 112. For a stator 150 having two sections (S1-S2), a first section (S1) of the elastomeric stator lining 120 toward the first end of the metallic housing 110 can be defined with a first stiffness being greater than a second stiffness of a second section (S2)

of the stator 150 toward the second end of the metallic housing 100. The first stiffness can be produced with a first elastomer 127*a*, and the second stiffness can be produced with a second elastomer 127*b*. Injection molding inside the housing bore 112 can start with the first elastomer 127*a* for the first section (S1) and can then switch to injection molding with the second elastomer 127*b* to complete the stator lining 120.

A metallic rotor 150 formed according to standard practices when positioned in an internal passage 122 of the elastomeric stator lining 120 can thereby produce a first fit between the first section (S1) and the rotor 150, which can be tighter than a second fit between the second section (S2) and the rotor 150.

For a stator lining 120 having three sections (S1-S3) as depicted in FIG. 7, an end section (S1) of the elastomeric stator lining 120 toward one end of the metallic housing 110 can be defined with a stiffness ($K_1$), which can be greater than another stiffness ($K_3$) of another end section (S3) of the stator lining 120 toward the other end of the metallic housing 110. An intermediate section (S2) can have an intermediate stiffness ($K_2$) between the end stiffnessess ($K_1$) ($K_3$). The one stiffness ($K_1$) can be produced with a first elastomer 127*a*, the other end stiffness ($K_3$) can be produced with another elastomer 127*c*, and the intermediate stiffness ($K_2$) can be produced by a blend or mix 127*b* of the end elastomers 127*a*, 127*c*. Injection molding inside the housing bore 112 can start with the end elastomer 127*a* for the end section (S1), can then switch to injection molding with a mix 127*b* of the end elastomers 127*a*, 127*c* for the intermediate section (S2), and finally switch to injection molding with the other end elastomer 127*c* for the other end section (S3).

A metallic rotor 150 formed according to standard practices when positioned in the internal passage 122 of the elastomeric stator lining 120 can thereby produce a first fit between the end section (S1) and the rotor 150 being tighter than an intermediate fit between the intermediate section (S2) and the rotor 150, which in turn can be tighter than a second fit between the other end section (S3) and the rotor 150.

Figure 8:
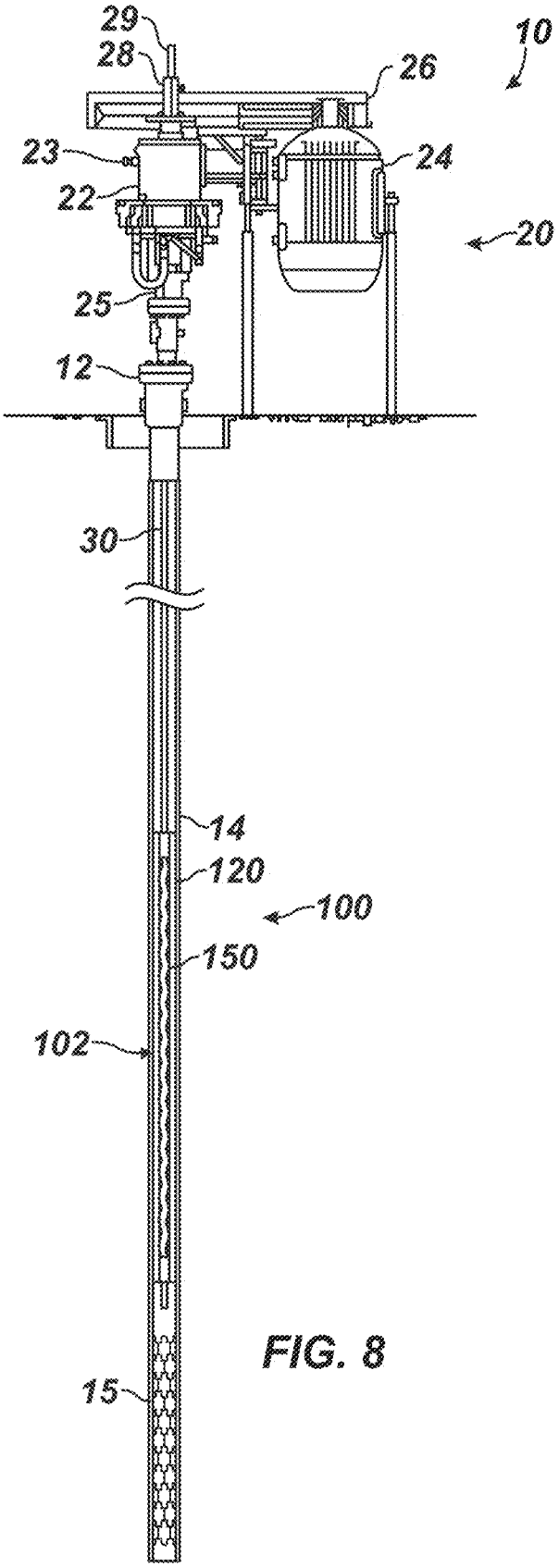
FIG. 8 illustrates a progressing cavity device mounted downhole in a wellbore as a progressing cavity pump.

Previous discussions have details aspects of the disclosed power section 102 when used in a progressing cavity device 100 operating as a motor. As opposed to a motor, the progressing cavity device 100 can in general operate as a pump for pumping fluids with the inner gear (rotor) rotated in the outer gear (stator) by a drive, typically a rod string connected to a drive mechanism at surface. As shown in FIG. 8, for example, the progressing cavity device 100 of the present disclosure can be used for a progressing cavity pump in a pump system 10. The pump system 10 has a surface drive 20, a drive string 30, and the downhole progressing cavity device 100.

At the surface of the well, the surface drive 20 has a drive head 22 mounted above a wellhead 12 and has an electric or hydraulic motor 24 coupled to the drive head 22 by a pulley/belt or gearbox assembly 26. The drive head 22 typically includes a stuffing box 25, a clamp 28, and a polished rod 29. The stuffing box 25 is used to seal the connection of the drive head 20 to the drive string 30, and the clamp 28 and the polished rod 29 are used to transmit the rotation from the drive head 22 to the drive shaft 30.

Downhole, the progressing cavity device 100 installs below the wellhead 12 at a substantial depth (e.g., about 2000 m) in the wellbore. As shown, the device 100 has a helical-shaped inner gear or rotor 150 that turns inside a helical-lined outer gear or stator lining 120. During operation, the stator lining 120 attached to the production tubing string 14 remains stationary, and the surface drive 20 coupled to the rotor 150 by the drive string 30 causes the rotor 150 to turn eccentrically in the stator lining 120. As a result, a series of sealed cavities form between the stator lining 120 and the rotor 150 and progress from the suction end downhole to the discharge end uphole on the device 100, which produces a non-pulsating positive displacement flow of fluid up the tubing 14.

An intake 15 in the tubing string 14 allows fluid to enter the tubing string 14 on the suction end of the device 100. A joint (not shown) can couple the rod string 30 to the rotor 150, which can allow the rotor 150 to orbits within the stator lining 120. With this action, fluid can be pumped up the wellbore from the suction end through the progressing cavities formed between the stator lining 120 and the rotor 150, out the discharge end of the device 100, and then up through the tubing string 14 for eventual production at surface.

Because the device 100 is located near the bottom of the wellbore, which may be several thousand feet deep, pumping oil to the surface requires very high pressure. The drive string 30 coupled to the rotor 150 is typically a steel stem having a diameter of approximately 1-in. and a length sufficient for the required operations. During pumping, the string 30 may be wound torsionally several dozen times so that the string 30 accumulates a substantial amount of stored energy. In addition, the height of the fluid column above the device 100 can produce hydraulic energy on the drive string 30 and on the stator lining 120 while the device 100 is producing. This hydraulic energy increases the energy of the twisted string 30 because it causes the device 100 to operate as a hydraulic motor, rotating in the same direction as the twisting of the drive string 30.

Figure 9A:
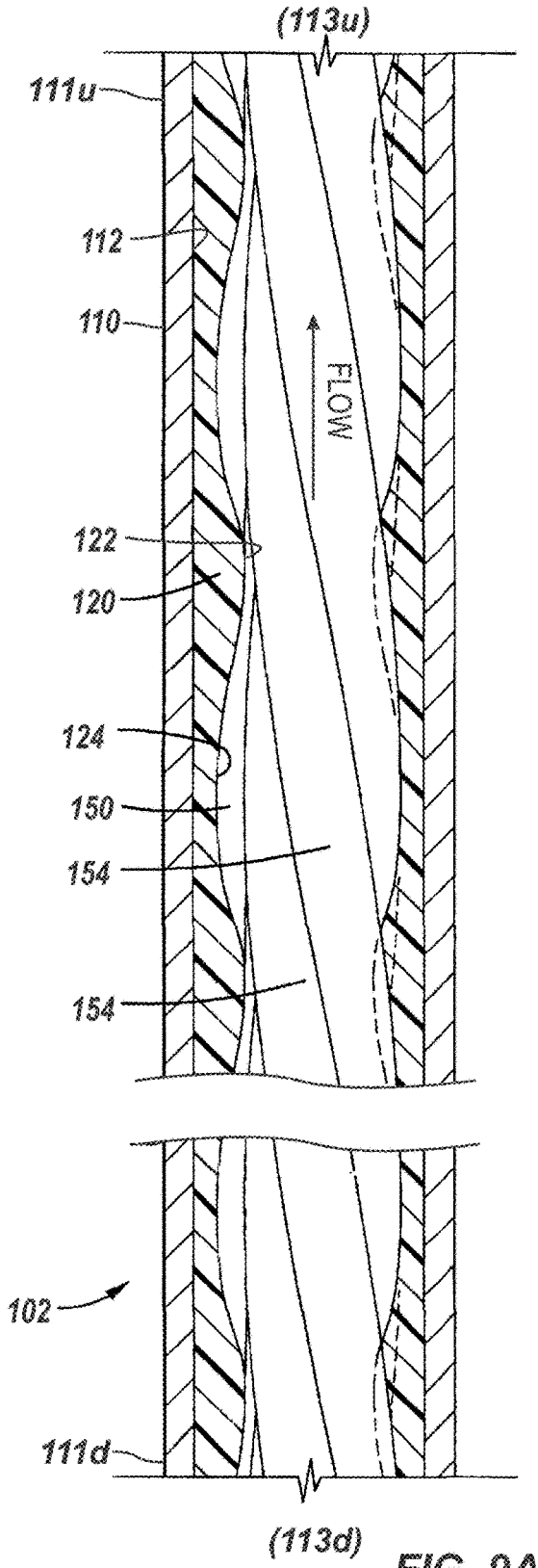
FIGS. 9A-9B schematically illustrate cross-sectional views of a progressing cavity pump of the device as in FIG. 8.
Figure 9B:
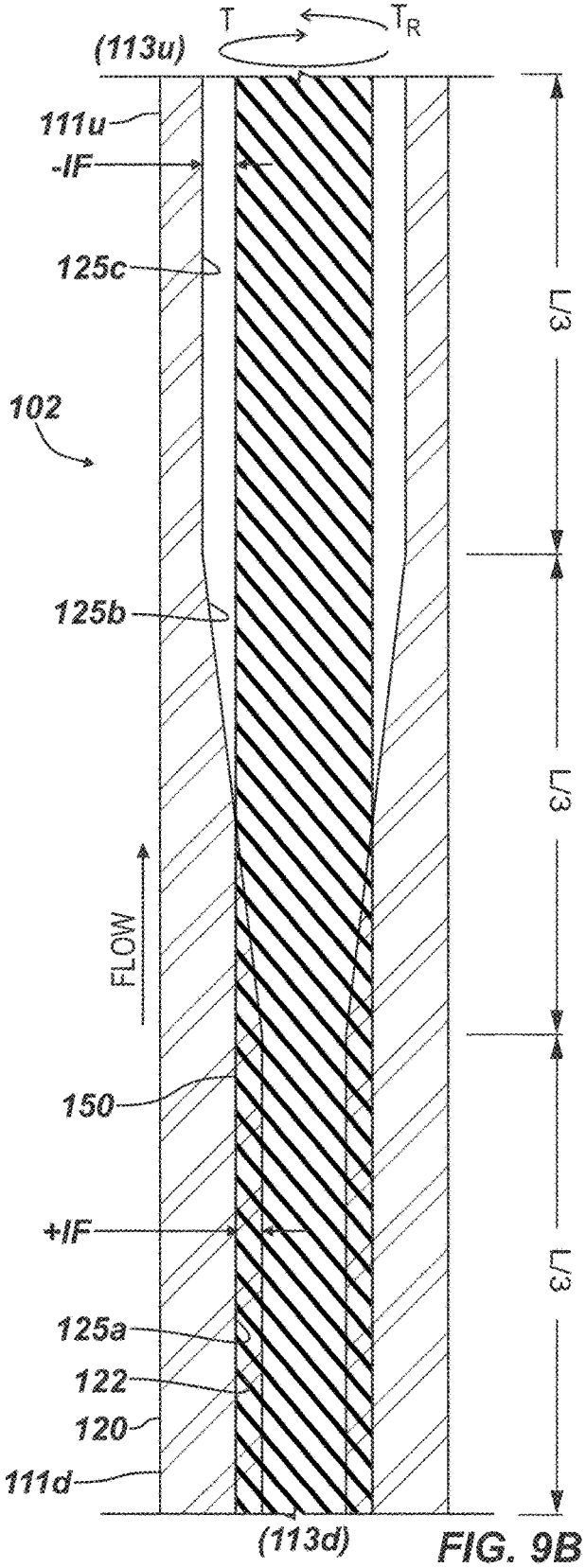

Turning to FIGS. 9A-9B, the device's power section 102 is illustrated for being operated as a pump. Details discussed above with respect to FIGS. 2A-2B can apply equally to the configuration of the power section 102 depicted here in FIGS. 9A-9B. In contrast to the power section 102 used as motor, the cavities formed between the rotor 150 and the stator lining 120 for the power section 102 used as a pump progress from a suction (low pressure) end 111*d* of the device 100 to a discharge (high pressure) end 111*u* of the device's power section 102 as the rotor 150 is turned (i.e., by a driven rod string) within the stator 150. Accordingly, the downhole end 111*d* of the housing 110 receives fluid from a downhole suction inlet 113*d*, while the uphole end 111*u* of the housing 110 discharges the pumped fluid out an uphole discharge outlet 113.

To rotate the rotor 150, torque (T) is provided to the rotor 150 at the uphole end 111*u* by a coupling to a drive, such as a rod string. For example, an uphole coupling (not shown) of the rotor 150 to a drive string allows rotation from the drive string to turn the rotor 150 within the stator lining 120. (Details of such a coupling can be found in U.S. Pat. Nos. 6,358,027 and 6,457,958, which are incorporated herein by reference.) As the rotor 150 rotates, fluid from the wellbore enters the suction inlet 113*d* of the downhole end 111*d* and exits the discharge 113*u* of the uphole end 113*u*.

During operation, additional torque (referred here as reactive torque ($T_R$)) acts with the imparted torque (T) on the power section 102. The reactive torque ($T_R$) can come from the drive at the uphole end 111*u* of the rotor 150 due the twisting or windup of the rod string coupled to the rotor 150. The reactive torque ($T_R$) can also come from the counter-rotation placed on the stator lining 120 by the pumping of fluid up through the stator lining 120 and by the hydraulic pressure of the fluid column above the stator lining 120 that attempts to rotate the stator lining 120. As a result, the stage of the device 100 closest to the drive on the power section 102 (i.e., uphole stage near the uphole end 111*u*) may perform a greater amount of work that generates heat. Yet, for the purposes of improving operation of the device's power section 102 as a pump, the different interference fit (–IF) for the upper portion (i.e., one or more upper stages) of the power section 102 as disclosed herein can thereby counteract or reduce the effects of generated heat, such as the weakening of the elastomer material properties and possible damage to the stator lining 120.

The arrangement in FIG. 9B is depicted as an inverse of the arrangement depicted in FIG. 2B. As will be appreciated, each of the arrangements disclosed herein, such as in FIGS. 6A-6F, can be inverted for the purposes of using the stator lining 120 in a progressing cavity pump. Moreover, depending of the operation of the device 100 operating as a pump for a particular implementation, the power section 102 for use in the pump may actually have and use the same arrangements (without inversion) as used for the power section 102 for use in a motor. Accordingly, the power section 102 used in the device 100 as a pump, such as disclosed in FIG. 8, can include all of the same arrangements discussed previously with reference to the power section's use as a motor. This would be particularly advantageous when the inlet stages at the downhole end of the power section 102 for the pump perform most of the work and generate heat during operation.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In general, the device can operate as a motor through which pumped fluids flow to rotate the inner gear to produce torque of a drive, such as an output shaft coupled to a cutting tool, an end mill, or a drill bit. In general, the device can operate as a pump for pumping fluids with the inner gear rotated by a drive, typically a rod string connected to a drive mechanism at surface. Therefore, the terms "pump" and "motor" may be used interchangeably herein depending on the implementation. Accordingly, the progressing cavity device of the present disclosure can be a progressing cavity pump, a progressing cavity motor, a positive displacement motor, a drilling motor, a mud motor, a mud pump, or a power section 102 of some other downhole apparatus.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A device, of a progressive cavity motor, for imparting a first torque to a drive using fluid that has been pumped along a tubular to the device, the device comprising:

a housing coupling in fluid communication with the tubular, the housing having an uphole end and a downhole end and defining a bore therethrough, the uphole end arranged to receive the fluid, the downhole end arranged to discharge the fluid;

a stator lining disposed in the bore of the housing and defining an internal profile along a first length of the stator lining, the internal profile at least having a first portion toward the uphole end of the housing and arranged to receive the fluid, the first portion having a first internal dimension being less than a second internal dimension of at least a second portion, the second portion disposed toward the downhole end of the housing and arranged to discharge the fluid, the stator lining comprising an elastomeric material, the elastomeric material comprising a first section toward the uphole end of the housing having a first stiffness being greater than a second stiffness of at least a second section toward the downhole end of the housing; and a rotor having an external profile along a second length of the rotor and disposed in the internal profile of the stator lining, the rotor having an upper end and a lower end, the lower end connected to the drive, the rotor defining a plurality of sealed stage cavities with the stator lining, the rotor being torqued in the stator lining in response to the fluid progressing in the sealed stage cavities from the uphole end to the downhole end and transferring the first torque to the drive connected to the lower end of the rotor toward the downhole end of the housing, the external profile having an outer dimension constant along the second length of the rotor, the device subjected to a reactive torque from the drive connected at the lower end of the rotor, the reactive torque opposed to the first torque imparted by the rotor to the drive and generating heat in the stator lining at least toward the downhole end of the housing, the first portion of the stator lining at least having a first interference fit with the rotor being greater than a second interference fit of the second portion of the stator lining with the rotor, the second interference fit configured to counteract the generated heat due to the reactive torque.

2. The device of claim 1, wherein the internal profile of the stator lining defines a plurality of first lobes pitched along the first length of the stator lining; and wherein the external profile of the rotor defines a plurality of second lobes pitched along the second length of the rotor and being less in number than the first lobes.

3. The device of claim 1, wherein the first and second portions each encompass a same number of the sealed stage cavities.

4. The device of claim 1, wherein the first internal dimension of the first portion of the internal profile is constant along the first length; and wherein the second internal dimension of the second portion tapers therefrom at an increasing angle outward.

5. The device of claim 1, wherein the first internal dimension of the first portion of the internal profile tapers at a first increasing angle outward; and wherein the second internal dimension of the second portion tapers therefrom at a second increasing angle outward.

6. The device of claim 5, wherein the first and second angles are the same.

7. The device of claim 1, wherein the first internal dimension of the first portion of the internal profile tapers at an increasing angle outward; and wherein the second internal dimension of the second portion is constant along the remaining first length.

8. The device of claim 1, wherein the first and second internal dimensions are constant along the first length and transition one to the other between the first and second portions.

9. The device of claim 1, wherein the internal passage comprises a third portion further toward the downhole end of the housing with a third internal dimension being greater at least in part than the second internal dimension of the second portion.

10. The device of claim 9, wherein the first internal dimension of the first portion of the internal profile is constant; wherein the second internal dimension of the second portion tapers therefrom at an increasing angle outward; and wherein the third internal dimension of the third portion is constant.

11. The device of claim 9, wherein the first, second, and third internal dimensions are each constant respectively along the first, second, and third portions of the first length and transition one to the other.

12. The device of claim 1, further comprising a coupling of the rotor to a cutting tool of the drive driven with the fluid progressing from the uphole end to the downhole end.

13. The device of claim 1, wherein the elastomeric material comprises an intermediate section disposed between the first and second sections and having an intermediate stiffness between the first and second stiffnesses.

14. The device of claim 13, wherein the elastomeric material comprises a first elastomer for the first section, a second elastomer for the second section, and a mix of the first and second elastomers for the intermediate section.

15. The device of claim 1, wherein the first interference being greater than the second interference fit further comprises the first interference fit between first helical lobe cavities of the internal profile and first helical lobes of the rotor having a tighter clearance than the second interference fit between second helical lobe cavities of the internal profile and second helical lobes of the rotor.

16. A device, of a progressive cavity motor, for imparting a first torque to a drive using fluid that has been pumped along a tubular to the device, the device comprising:

a housing coupling in fluid communication with the tubular, the housing having an uphole end and a downhole end and defining a bore therethrough;

a stator lining disposed in the bore of the housing and defining an internal profile along a first length of the stator lining, the internal profile at least having a first portion toward the uphole end of the housing with a first internal dimension being less than a second internal dimension of at least a second portion toward the downhole end of the housing, the stator lining comprising an elastomeric material, wherein the elastomeric material of the stator lining comprises a first section toward the uphole end of the housing having a first stiffness being greater than a second stiffness of at least a second section toward the downhole end of the housing, wherein the elastomeric material comprises a third section further toward the downhole end of the housing having a third stiffness being greater than the second stiffness of the second section; and a rotor having an external profile along a second length of the rotor and disposed in the internal profile of the stator lining, the rotor defining a plurality of sealed stage cavities with the stator lining, the rotor being torqued in the stator lining in response to the pumped drilling fluid progressing in the sealed stage cavities from the uphole end to the downhole end and transferring the first torque to the drive toward the downhole end, the external profile having an outer dimension constant along the second length of the rotor, the device subjected to a reactive torque generating heat toward the downhole end of the stator lining, the first portion of the stator lining at least having a first interference fit with the rotor being greater than a second interference fit of the second portion of the stator lining with the rotor.

17. The device of claim 16, wherein the elastomeric material comprises a first elastomer for the first section, a second elastomer for the third section, and a mix of the first and second elastomers for the second section.

18. A method of constructing a device of a progressing cavity motor, the method comprising:

forming an elastomeric stator lining in a bore of a metallic housing having uphole and downhole ends by:

defining a first portion of an internal passage of the elastomeric stator lining toward the uphole end of the metallic housing with a first internal dimension being less than a second internal dimension of at least a second portion of the internal passage toward the downhole end of the metallic housing, and defining a first section of the elastomeric stator lining toward the uphole end of the metallic housing with a first stiffness being greater than a second stiffness of at least a second section of the elastomeric stator lining toward the downhole end of the metallic housing;

forming a metallic rotor having an outer dimension constant along a second length of the rotor;

disposing the metallic rotor in the internal passage of the elastomeric stator lining with a first interference fit between the first portion and an upper end of the rotor being tighter than a second interference fit between the second portion and a lower end of the rotor;

arranging the uphole end of the metallic housing to receive fluid from a tubular connected to the metallic housing;

arranging the downhole end of the metallic housing to discharge the fluid; and connecting the lower end of the rotor to impart a first torque to a drive, wherein the second interference fit is configured to counteract heat generated in the elastomeric stator lining at least toward the downhole end of the metallic housing due to a reactive torque from the drive connected at the lower end of the rotor.

19. The method of claim 18, wherein defining the first and second sections of the elastomeric stator lining comprises defining an intermediate section disposed between the first and second sections and having an intermediate stiffness between the first and second stiffnesses.

20. The method of claim 19, wherein defining the intermediate section comprises using a first elastomer for the first section, using a second elastomer for the second section, and using a mix of the first and second elastomers for the intermediate section.

* * * * *